US009195209B2

(12) United States Patent
Souda

(10) Patent No.: US 9,195,209 B2
(45) Date of Patent: Nov. 24, 2015

(54) IMAGE FORMING APPARATUS

(71) Applicant: Brother Kogyo Kabushiki Kaisha, Nagoya-shi, Aichi-ken (JP)

(72) Inventor: Makoto Souda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/541,910

(22) Filed: Nov. 14, 2014

(65) Prior Publication Data

US 2015/0139687 A1 May 21, 2015

(30) Foreign Application Priority Data

Nov. 15, 2013 (JP) ..... 2013-237324

(51) Int. Cl.
*G03G 15/00* (2006.01)
*G03G 21/16* (2006.01)
*G03G 15/01* (2006.01)

(52) U.S. Cl.
CPC ..... *G03G 21/1671* (2013.01); *G03G 21/1619* (2013.01); *G03G 15/0194* (2013.01); *G03G 2221/1684* (2013.01)

(58) Field of Classification Search
CPC ..... G03G 21/1619; G03G 21/1671; G03G 2221/1678; G03G 21/16; G03G 2221/1654; G03G 2215/0141
USPC ..... 399/107, 411
See application file for complete search history.

(56) References Cited

U.S. PATENT DOCUMENTS

| | | | |
|---|---|---|---|
| 4,903,452 | A | 2/1990 | Huang |
| 5,208,612 | A | 5/1993 | Obu et al. |
| 6,069,646 | A | 5/2000 | Okabe et al. |
| 6,208,817 | B1 | 3/2001 | Chadani et al. |
| 7,567,769 | B2 | 7/2009 | Noguchi et al. |
| 7,706,716 | B2 | 4/2010 | Tada et al. |
| 7,783,226 | B2 | 8/2010 | Tomatsu |

(Continued)

FOREIGN PATENT DOCUMENTS

| | | |
|---|---|---|
| JP | S55-35461 | 8/1980 |
| JP | H10-161507 A | 6/1998 |

(Continued)

OTHER PUBLICATIONS

Dec. 24, 2014—(US) Application as filed—U.S. Appl. No. 14/582,753.

(Continued)

*Primary Examiner* — Francis Gray
(74) *Attorney, Agent, or Firm* — Banner & Witcoff, Ltd.

(57) ABSTRACT

An image forming apparatus, including: a plurality of image forming units arranged to align along a direction orthogonal to rotation axes of photosensitive drums; a first frame made of resin and arranged on one side of the photosensitive drums along the direction of rotation axes to support the plurality of image forming units; a first beam made of metal, formed in an elongated shape longitudinally along a direction to intersect with the aligning direction, and arranged along and fixed to a planar face of the first frame; and a second beam formed in an elongated shape extending along the aligning direction, arranged along the planar face of the first frame to intersect with the first beam, and fixed to the planar face of the first frame, is provided. Rigidity of the first beam is higher than rigidity of the second beam.

13 Claims, 21 Drawing Sheets

(56) References Cited

U.S. PATENT DOCUMENTS

| | | | | |
|---|---|---|---|---|
| 7,894,743 | B2 | 2/2011 | Tomatsu | |
| 8,175,491 | B2 | 5/2012 | Tomatsu et al. | |
| 8,244,153 | B2 | 8/2012 | Nakashima | |
| 8,428,486 | B2 | 4/2013 | Abe et al. | |
| 8,532,524 | B2 | 9/2013 | Souda | |
| 8,611,790 | B2 | 12/2013 | Souda | |
| 8,706,001 | B2 | 4/2014 | Yamauchi et al. | |
| 8,948,680 | B2 | 2/2015 | Nishimura | |
| 2003/0177999 | A1 | 9/2003 | Saito et al. | |
| 2007/0160382 | A1 | 7/2007 | Tomatsu | |
| 2008/0075502 | A1 | 3/2008 | Tada et al. | |
| 2008/0159773 | A1 | 7/2008 | Murayama et al. | |
| 2008/0159781 | A1 | 7/2008 | Noguchi et al. | |
| 2009/0317126 | A1* | 12/2009 | Tomatsu | 399/110 |
| 2010/0014887 | A1 | 1/2010 | Tomatsu et al. | |
| 2010/0080612 | A1 | 4/2010 | Nakashima | |
| 2010/0135689 | A1 | 6/2010 | Abe et al. | |
| 2011/0102983 | A1* | 5/2011 | Souda et al. | 361/679.01 |
| 2011/0129276 | A1* | 6/2011 | Kondo | 400/613 |
| 2011/0170932 | A1 | 7/2011 | Bhatia et al. | |
| 2011/0262173 | A1 | 10/2011 | Souda | |
| 2012/0038091 | A1 | 2/2012 | Tagawa | |
| 2013/0004198 | A1 | 1/2013 | Tomatsu | |
| 2013/0004199 | A1 | 1/2013 | Souda et al. | |
| 2013/0077990 | A1* | 3/2013 | Nakashima | 399/107 |
| 2013/0170857 | A1 | 7/2013 | Souda et al. | |
| 2014/0376943 | A1 | 12/2014 | Nishimura | |
| 2014/0376944 | A1 | 12/2014 | Souda et al. | |
| 2014/0376945 | A1 | 12/2014 | Souda et al. | |
| 2014/0376946 | A1 | 12/2014 | Souda et al. | |
| 2014/0376957 | A1 | 12/2014 | Souda et al. | |
| 2014/0376958 | A1 | 12/2014 | Souda et al. | |

FOREIGN PATENT DOCUMENTS

| | | | |
|---|---|---|---|
| JP | 2000-177202 | A | 6/2000 |
| JP | 2000-352921 | A | 12/2000 |
| JP | 2003-278739 | A | 10/2003 |
| JP | 2003-343541 | A | 12/2003 |
| JP | 2004-068862 | A | 3/2004 |
| JP | 2004-151510 | A | 5/2004 |
| JP | 2005-037652 | A | 2/2005 |
| JP | 2006-239876 | A | 9/2006 |
| JP | 2007-148142 | A | 6/2007 |
| JP | 2008-065122 | A | 3/2008 |
| JP | 2008-165027 | A | 7/2008 |
| JP | 2010-026152 | A | 2/2010 |
| JP | 2010-044363 | A | 2/2010 |
| JP | 2010-079046 | A | 4/2010 |
| JP | 2010-128337 | A | 6/2010 |
| JP | 2011-232513 | A | 11/2011 |
| JP | 2013-137426 | A | 7/2013 |

OTHER PUBLICATIONS

Dec. 24, 2014—(US) Application as filed—U.S. Appl. No. 14/582,630.
Dec. 24, 2014—(US) Application as filed—U.S. Appl. No. 14/582,715.
Dec. 24, 2014—(US) Application as filed—U.S. Appl. No. 14/582,720.
Feb. 18, 2015—Notice of Allowance—U.S. Appl. No. 14/305,351.
Feb. 24, 2015—(US) Non-Final Office Action—U.S. Appl. No. 14/305,046.
Mar. 5, 2015—(US) Notice of Allowance—U.S. Appl. No. 14/305,093.
Apr. 13, 2015—(US) Non-Final Office Action—U.S. Appl. No. 14/305,040.
Apr. 9, 2015—(US) Non-Final Office Action—U.S. Appl. No. 14/305,083.
Apr. 13, 2015—(US) Ex Parte Quayle Office Action—U.S. Appl. No. 14/305,068.
Jun. 11, 2015—(US) Ex Parte Quayle Office Action—U.S. Appl. 14/582,753.
Jul. 2, 2015—(US) Non-Final Office Action—U.S. Appl. No. 14/582,630.

* cited by examiner

IMAGE FORMING APPARATUS

CROSS REFERENCE TO RELATED APPLICATION

This application claims priority from Japanese Patent Application No. 2013-237324 filed on Nov. 15, 2013, the entire subject matter of which is incorporated herein by reference.

BACKGROUND

1. Technical Field

An aspect of the present invention relates to an image forming apparatus having a resin frame, which is configured to support image forming units with a plurality of photosensitive drums.

2. Related Art

An image forming apparatus having side frames, which are made of metal with rigidity, to support an image forming unit laterally, is known. In the image forming apparatus, while the side frames arranged on sides of the image forming unit may be made of metal, resin frames may be coupled to lower ends of the metal frames.

SUMMARY

In the image forming apparatus with the above-mentioned frame structure with the metal-made side frames, a weight of the image forming apparatus may be increased. In this respect, in order to reduce the weight, resin-made side frames may be employed in the image forming apparatus in place of the metal-made side frames. However, the side frames made of resin may be less rigid compared to the metal frames.

The present invention is advantageous in that an image forming apparatus, in which rigidity of a frame to support image forming units is increased while a weight of the image forming apparatus is prevented from being increased, is provided.

According to an aspect of the present invention, an image forming apparatus, including a plurality of image forming units, each of which comprises a photosensitive drum configured to be rotatable about a rotation axis, the plurality of image forming units being arranged to align along an aligning direction orthogonal to a direction of rotation axes of the photosensitive drums; a first frame made of resin and arranged on one side of the plurality of image forming units along the direction of rotation axes, the first frame being configured to support the plurality of image forming units; a first beam made of metal and formed in an elongated shape longitudinally along a direction to intersect with the aligning direction of the plurality of image forming units, the first beam being arranged along a planar face of the first frame and fixed to the planar face of the first frame; and a second beam formed in an elongated shape extending along the aligning direction, the second beam being arranged along the planar face of the first frame to intersect with the first beam and fixed to the planar face of the first frame, is provided. Rigidity of the first beam is higher than rigidity of the second beam.

BRIEF DESCRIPTION OF THE ACCOMPANYING DRAWINGS

DETAILED DESCRIPTION

Hereinafter, a configuration of a color printer 1 according to an embodiment of the present invention will be described with reference to the accompanying drawings. First, an overall configuration of the color printer 1 will be described, and second, specific components in the color printer 1 will be described in detail.

Figure 1:
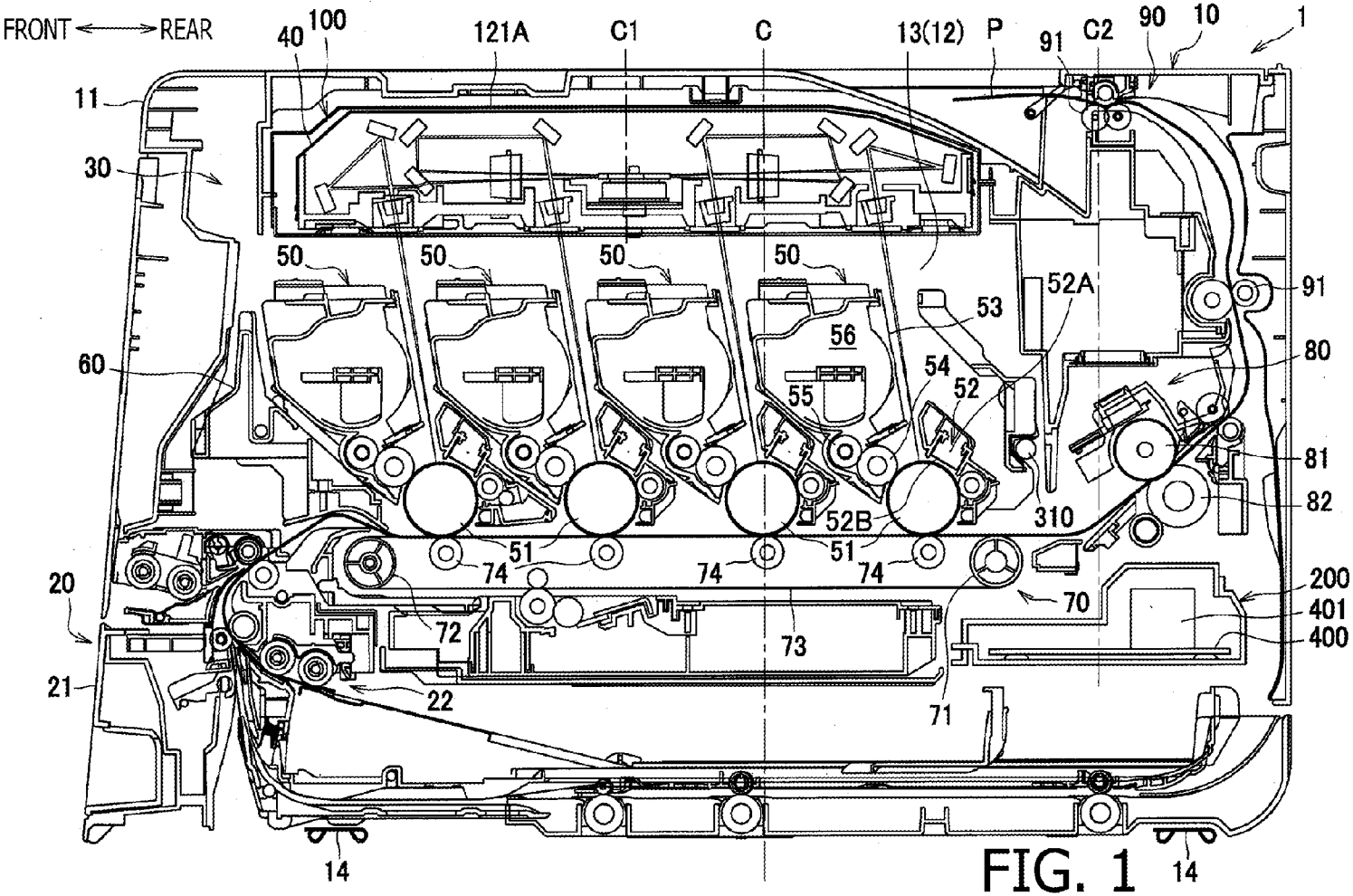
FIG. 1 is a cross-sectional side view of a color printer according to an embodiment of the present invention.

In the following description, directions concerning the color printer 1 will be referred to in accordance with orientation indicated by arrows in each drawing. Therefore, for example, a viewer's left-hand side appearing in FIG. 1 is referred to as a front side of the color printer 1, and a right-hand side in FIG. 1 opposite from the front side is referred to as a rear side. A side which corresponds to the viewer's nearer side is referred to as a right-hand side for a user, and an opposite side from the right, which corresponds to the viewer's farther side is referred to as a left-hand side for the user. An up-down direction in FIG. 1 corresponds to a vertical direction of the color printer 1. Further, the right-to-left or left-to-right direction of the color printer 1 may be referred to as a widthwise direction, and the front-to-rear or rear-to-front direction may be referred to as a direction of depth. The widthwise direction and the direction of depth are orthogonal to each other. Furthermore, directions of the drawings in FIGS. 2-21 are similarly based on the orientation of the color printer 1 as defined above and correspond to those with respect to the color printer 1 shown in FIG. 1 even when the drawings are viewed from different angles.

Overall Configuration of the Color Printer

The color printer 1 includes a feeder unit 20, an image forming unit 30, and an ejection unit 90, which are arranged inside a body 10. The feeder unit 20 is configured to feed a sheet P in the body 10, the image forming unit 30 is configured to form an image on the sheet P being fed, and the ejection unit 90 is configured to eject the sheet P with the image formed thereon outside. A configuration of the body 10 of the color printer 1 will be described later in detail.

The feeder unit 20 includes a feeder tray 21 to store the sheet P therein and a sheet conveyer 22 to convey the sheet P from the feeder tray 21 to the image forming unit 30.

The image forming unit 30 includes an optical scanner 40, a plurality of (e.g., four) processing units 50, a drawer 60, a transfer unit 70, and a fixing unit 80.

The optical scanner 40 is arranged on one side of the plurality of processing units 50 along a direction orthogonal to an axial direction and to an aligning direction of photosensitive drums 51, which will be described later in detail. In other words, the optical scanner 40 is arranged in an upper position with respect to the plurality of processing units 50, in the body 10. The optical scanner 40 includes a laser-beam emitter (not shown), a plurality of polygon mirrors (unsigned), lenses (unsigned), and a plurality of reflection mirrors (unsigned). Laser beams emitted from the laser-beam emitter for a plurality of (e.g., four) colors are reflected on the polygon mirrors and the reflection mirrors and transmit through the lenses to be casted to scan on surfaces of photosensitive drums 51 in the processing units 50.

The plurality of processing units 50 are aligned in line, along a direction of depth (i.e., a front-rear direction) of the color printer 1, orthogonally to the axial direction of rotation axes of the photosensitive drums 51. Each of the processing units 50 includes the photosensitive drum 51, which is rotatable about a rotation axis thereof extending along the widthwise direction, a charger 52 to electrically charge the photosensitive drum 51, and a developer cartridge 53. Each developer cartridge 53 includes a developer roller 54 to supply a developer agent (e.g., toner) to the photosensitive drum 51 and a toner container 56 to store the toner therein. All the processing units 51 are configured similarly but different from one another in colors of the toner contained in the toner containers 56.

Each of the chargers 52 includes a charging wire 52A and a grid electrode 52B. The grid electrode 52B is arranged in a position between the charging wire 52A and the photosensitive drum 51.

Figure 2:
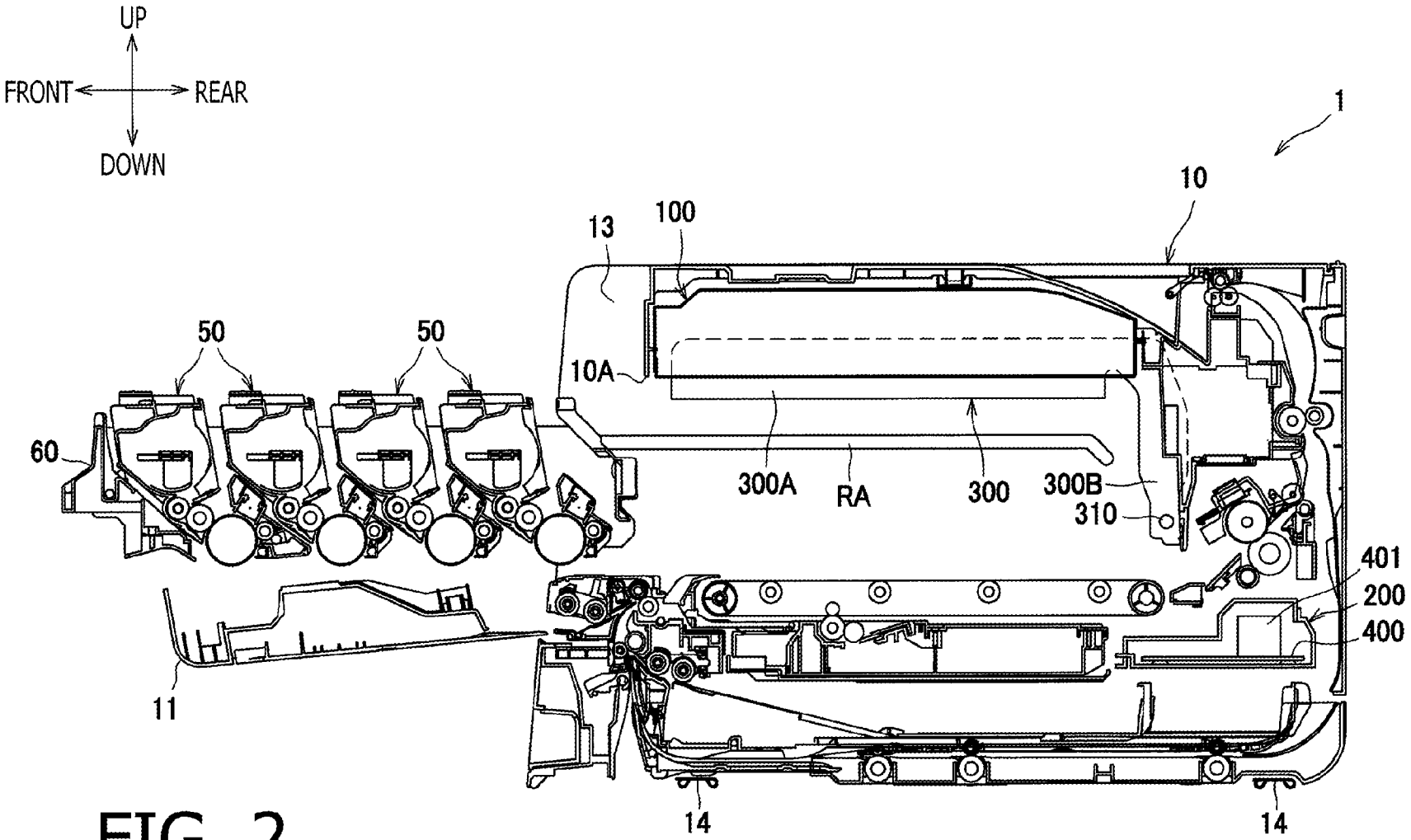
FIG. 2 is a cross-sectional side view of the color printer with a drawer being drawn out of a body of the color printer according to the embodiment of the present invention.
Figure 3:
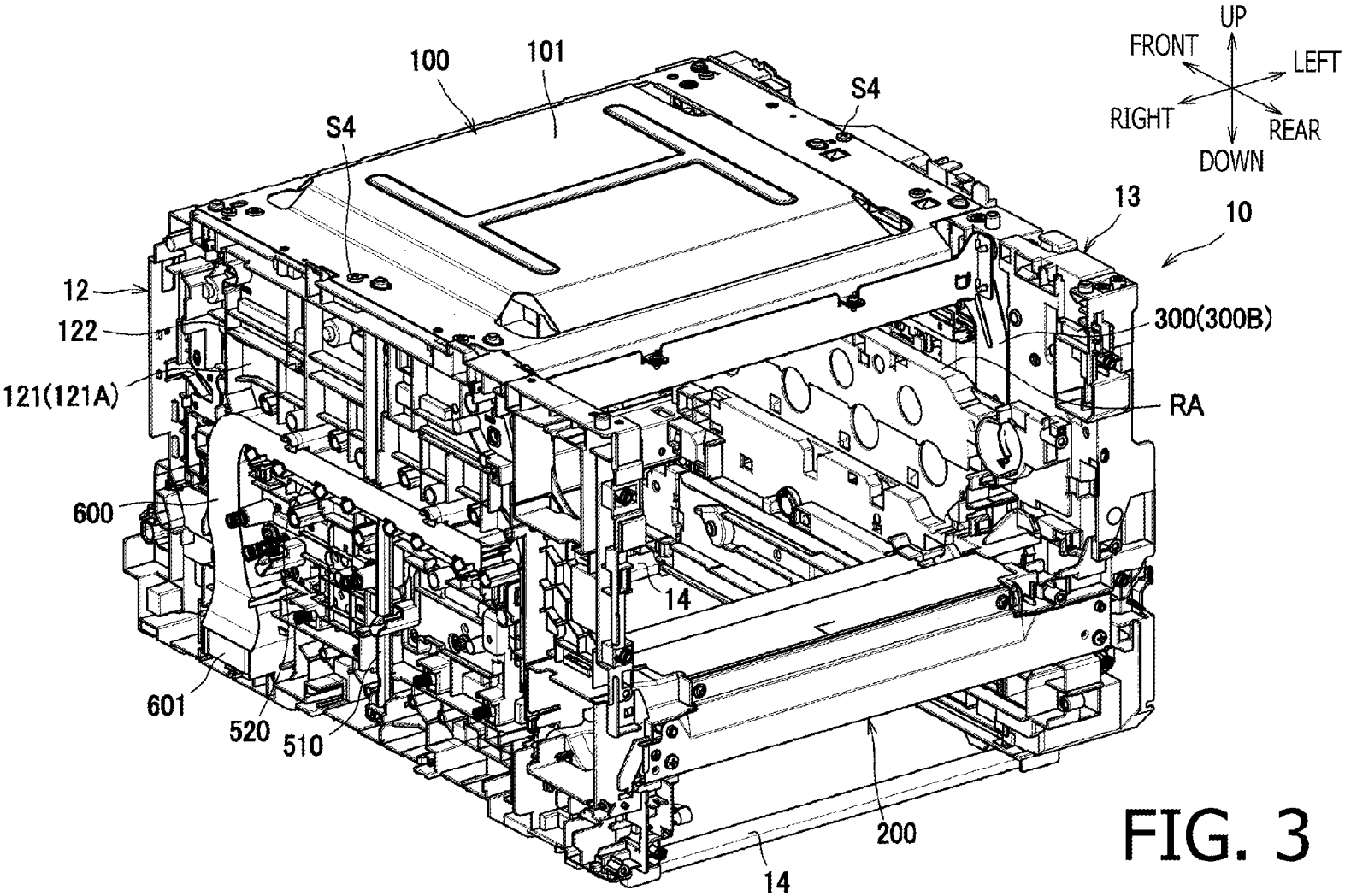
FIG. 3 is a perspective view of the body of the color printer with a framework according to the embodiment of the present invention.

The drawer 60 supports the plurality of processing units 50 and is movable along the front-rear direction with respect to a pair of side frames 12, 13, which form lateral walls of the body 10 of the color printer 1. Each of the side frames 12, 13 is provided with a rail RA, solely one of which on the left is shown in FIGS. 2 and 3, so that the drawer 60 is guided by the rails RA to move frontward or rearward along the front-rear direction. As shown in FIG. 2, the drawer 60 can be drawn out of the body 10 of the color printer 10 through an opening 10A, which is exposed when a front cover 11 arranged on the front side of the body 10 is opened. Thus, the processing units 50 are exposed to the outside atmosphere.

Referring back to FIG. 1, the transfer unit 70 is arranged in a position between the feeder unit 20 and the drawer 60. The transfer unit 70 includes a driving roller 71, a driven roller 72, a conveyer belt 73, and transfer rollers 74.

The driving roller 71 and the driven roller 72 are arranged to extend axially in parallel with each other in spaced-apart positions from each other along the front-rear direction so that the conveyer belt 73 being an endless belt is strained to roll around the driving roller 71 and the driven roller 72. The conveyer belt 73 is arranged to have an upper outer surface thereof to be in contact with the photosensitive drums 51. A plurality of (e.g., four) transfer rollers 74 are arranged in positions opposite from the photosensitive drums 51 across the conveyer belt 73, and the conveyer belt 73 is in contact with the transfer rollers 74 at an upper inner surface thereof. Transfer bias under constant current control is applied to the transfer rollers 74 to transfer an image from the photosensitive drums 51 to the sheet P.

The fixing unit 80 is arranged in a rear position with respect to the processing units 50 and includes a heat roller 81 and a pressure roller 82. The pressure roller 82 is arranged in a position to face the heat roller 81 and is urged against the heat roller 81.

In each of the processing units 50 in the image forming unit 30 configured as above, the charger 52 electrically charges a surface of the photosensitive drum 51 evenly, and the surface of the photosensitive drum 51 is exposed to the laser beam emitted selectively based on image data from the optical scanner 40 in order to form a lower-potential regions, i.e., an electrostatic latent image representing the image to be formed on the sheet P, thereon. Thereafter, the toner is supplied to the latent image on the photosensitive drum 51 from the developer cartridge 53 through the developer roller 54. Thus, the latent image is developed to be a toner image and carried on the surface of the photosensitive drum 51.

When the sheet P supplied from the feeder unit 20 is carried on the conveyer belt 73 to a position between the photosensitive drum 51 and the transfer roller 74, the toner image formed on the surface of the photosensitive drum 51 is transferred onto the sheet P. Thus, four colored images are sequentially overlaid on the surface of the sheet P to form a colored image. The sheet P with the transferred toner images is carried to a nipped position between the heat roller 81 and the pressure roller 82 in the fixing unit 80 to have the toner images thermally fixed thereon.

The ejection unit 90 includes a plurality of conveyer rollers 91 to convey the sheet P. The sheet P with the fixed image is ejected out of the body 10 of the color printer 1 by the conveyer rollers 91.

Configuration of the Body 10 of the Color Printer 1

As shown in FIG. 3, the body 10 of the color printer 1 includes the paired side frames 12, 13, a first connecting frame 100 to connect upper portions of the side frames 12, 13, a second connecting frame 200 to connect lower rear portions of the side frames 12, 13, and lower beams 14 to connect lower ends of the side frames 12, 13. The lower beams 14 are elongated metal bars extending along the widthwise direction. One of the lower beams 14 is arranged on the front side of the side frames 12, 13, and another one of the lower beams 14 is arranged on the rear side of the side frames 12, 13.

The side frames 12, 13 are resin plates, each of which is formed to have an approximate shape of a rectangle, and are arranged on the left side and the right side in the color printer 1 to have a predetermined amount of clearance there-between to accommodate the processing units 50 therein. The processing units 50 disposed in the clearance are supported by the side frames 12, 13 via the drawer 60. In the following description, one of the side frames 12, 13 arranged on the right-hand side may be referred to as a right-side frame 12, and the other one of the side frames 12, 13 arranged on the left-hand side may be referred to as a left-side frame 13.

The right-side frame 12 supports right-side ends of the processing units 50 via the drawer 60. As shown in FIG. 3, the right-side frame 12 includes flat parts 121 having flat surfaces 121A, which spread orthogonally to the widthwise direction, and enhancing ribs 122, which protrude inward or outward from the flat parts 121 along the widthwise direction. The right-side frame 12 is enhanced by a first metal beam 510 and a second metal beam 520 (see FIG. 5), which will be described later in detail.

The left-side frame 13 is arranged to face the right-side frame 12 across the processing units 50 and supports left-side ends of the processing units 50 via the drawer 60. The left-side frame 13 includes the flat parts (unsigned) and enhancing ribs (unsigned), which are formed in shapes similar to the flat parts 121 and the enhancing ribs 122 in the right-side frame 12. On an outer side of the left-side frame 13 along the widthwise direction, a driving mechanism (not shown), including a plurality of gears to drive the photosensitive drums 51, is disposed. Thus, the driving mechanism disposed on the left-side frame 13 can enhance rigidity of the left-side frame 13.

The first connecting frame 100 is a metal frame forming a shape of a sleeve, which is hollow and provides a space inside, and a cross-section of the first connecting frame 100 taken along a plane orthogonal to the widthwise direction is closed. Widthwise ends of the first connecting frame 100 are connected to the side frames 12, 13. The first connecting frame 100 is arranged in an upper position with respect to the processing units 50 and accommodates the optical scanner 40 in the hollow space.

With the sleeve-shaped first connecting frame 100 connected to the side frames 12, 13 at the widthwise ends thereof, the first connecting frame 100 can enhance rigidity of the side frames 12, 13. In this regard, while the optical scanner 40 is accommodated in the first connecting frame 100, the first connecting frame 100 may not only provide the improved rigidity to the color printer 1 but also protect the optical scanner 40 securely.

The first connecting frame 100 is formed to have a dimension in the front-rear direction being substantially equivalent to a dimension in the front-rear direction of the drawer 60 and is arranged to overlap the processing units 50 in a perspective view projected along the vertical direction. Thus, due to the first connecting frame 100 arranged over the processing units 50, the rigidity of the side frames 12, 13 may be enhanced effectively by the first connecting frame 100.

Meanwhile, the first connecting frame 100 is arranged to locate a center C1 thereof along the front-rear direction in a frontward position deviated from a center C of the side frames 12, 13 along the front-rear direction. In other words, the first connecting frame 100 is arranged in a frontward off-centered position closer to the front ends rather than the rear ends of the side frames 12, 13.

Figure 4:
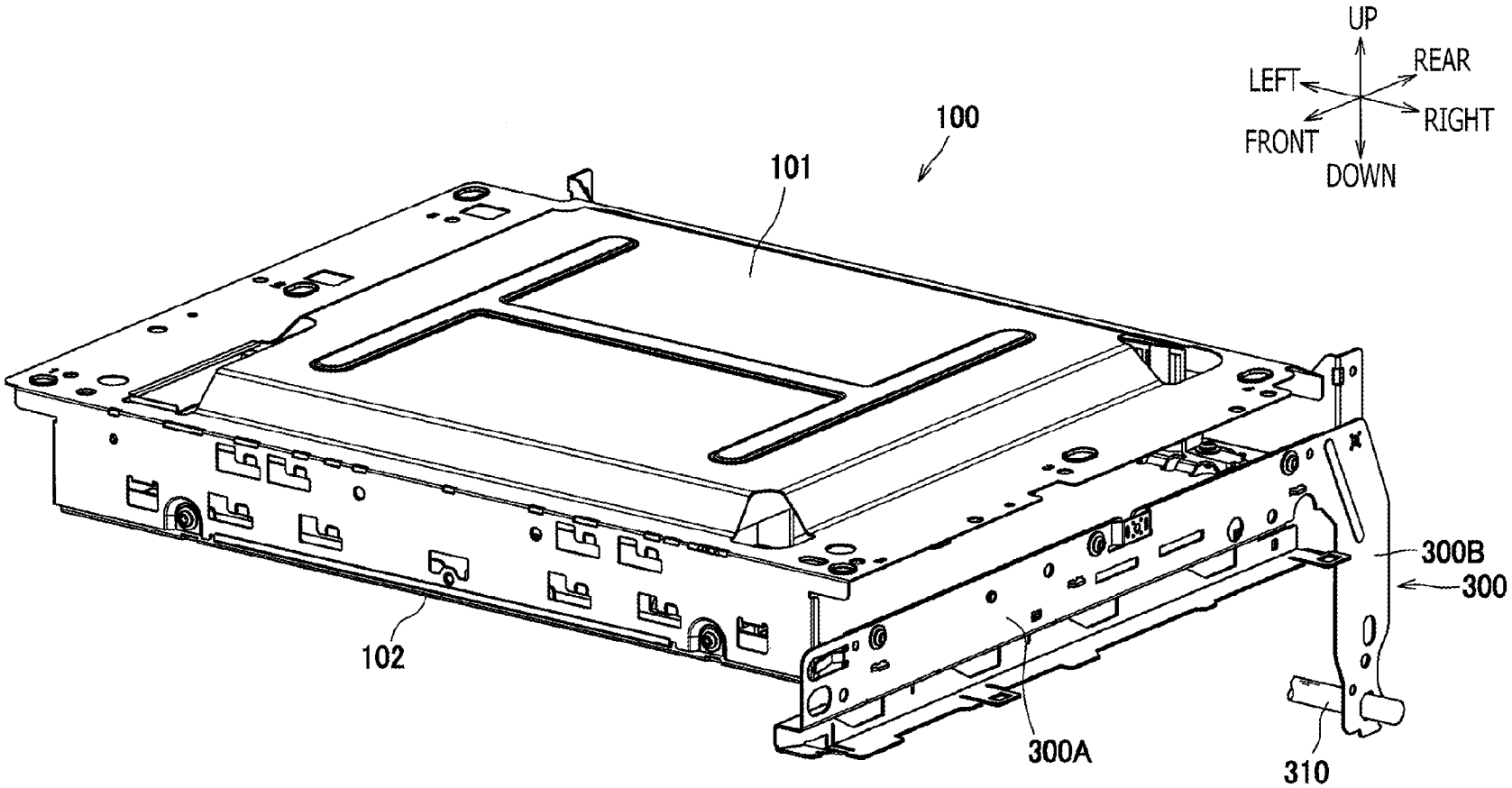
FIG. 4 is an exploded view of a first connecting frame and an L-shaped metal piece in the color printer according to the embodiment of the present invention taken from an upper front view point.

More specifically, as shown in FIGS. 3 and 4, the first connecting frame 100 is fixed to upper edges of the side frames 12, 13 by screws S4 at widthwise ends of a top wall 101 thereof, and to L-shaped metal pieces 300, which are fixed to the side frames 12, 13, at widthwise ends of a lower wall 102 thereof. Each of the L-shaped metal pieces 300 is a sheet of metal including a main part 300A elongated along the front-rear direction and an extended part 300B extended downward from the main part 300A toward a side where the photosensitive drums 51 are disposed. The main part 300A is arranged to overlap the first connecting frame 100 in a perspective view projected along the widthwise direction. The extended part 300B supports a positioning shaft 310 (see also FIG. 1), which is engageable with a rear part of the drawer 60 to place the drawer 60 in a correct position in the body 10 of the color printer 1. Each of the L-shaped metal pieces is fixed to an inner surface of the side frames 12, 13 along the widthwise direction.

As shown in FIGS. 1 and 3, the second connecting frame 200 is a metal frame formed in a shape of a sleeve, which is hollow and provides a space inside. A cross-section of the second connecting frame 200 is closed when taken along the plane orthogonal to the widthwise direction. The second connecting frame 200 is coupled to the side frames 12, 13 at widthwise ends thereof. The second connecting frame 200 is arranged in a lower position with respect to the processing units 50.

Thus, the first connecting frame 100 and the second connecting frame 200 are arranged to align along the vertical direction to place the processing units 50 interposed therebetween. Therefore, central areas of the side frames 12, 13, i.e., areas coincident with the processing units 50 along the direction of rotation axes, can be effectively enhanced.

According to the configuration described above, a central area C2 of the second connecting frame 200 along the front-rear direction is arranged in a rearward position deviated from the center C of the side frames 12, 13 along the front-rear direction. In other words, the second connecting frame 200 is arranged in the rearward off-centered position closer to the rear ends rather than the front ends of the side frames 12, 13.

Therefore, with regard to the relative position among the second connecting frame 200, the side frames 12, 13, and the first connecting frame 100, the first connecting frame 100 is disposed in the frontward position closer to the front ends of the side frames 12, 13 while the second connecting frame 200 is disposed in the rearward position closer to the rear ends of the side frames 12, 13. Thus, the first connecting frame 100 and the second connecting frame 200 are disposed in diagonal positions with respect to each other in the side frames 12, 13. Accordingly, the rigidity of the body 10 of the color printer 1 may be effectively improved.

According to the configuration described above, the second connecting frame 200 is formed to range from a position in proximity to the rear end of the first connecting frame 100 to a position in proximity to the rear ends of the side frames 12, 13 along the front-rear direction. Further, the second connecting frame 200 is arranged to overlap the first connecting frame 100, at least partly, in the perspective view projected along the vertical direction.

Therefore, an entire range of the side frames 12, 13 along the front-rear direction is enhanced by the first and second connecting frames 100, 200, and the rigidity of the first and second connecting frames 100, 200 may be effectively improved.

Meanwhile, inside the second connecting frame 200, a power board 400 to supply power to electrically movable components, such as the processing units 50, is disposed. On the power board 400, a transformer 401 (see FIGS. 1 and 2) being one of elements composing a power circuit, is mounted. While the power board 400 is accommodated in the metal-made second connecting frame 200, noises generated in the power board 400 may be prevented from being radiated.

Figure 5:
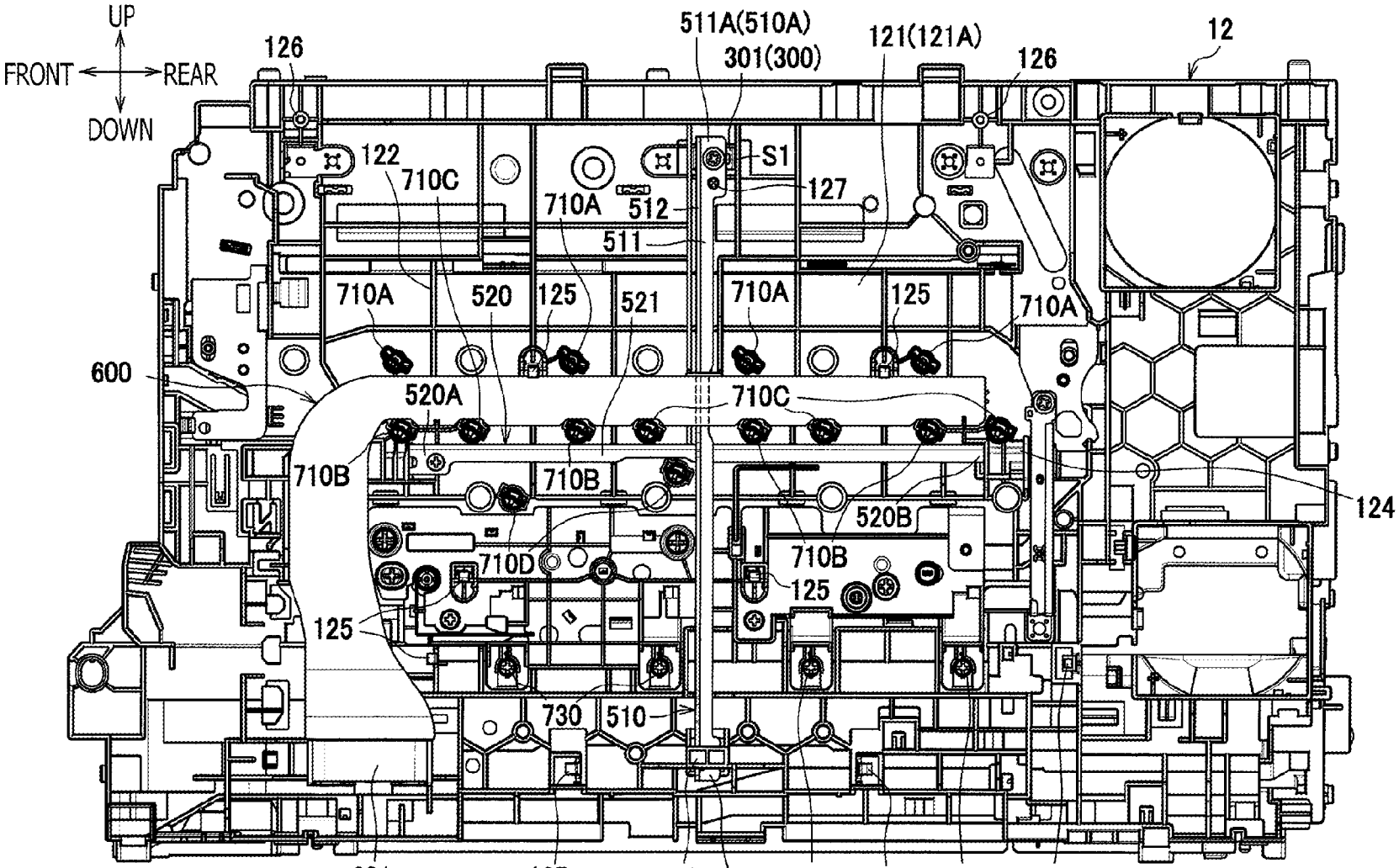
FIG. 5 is a lateral view of a right-side frame in the color printer according to the embodiment of the present invention viewed from an outer side along a widthwise direction.
Figure 6:
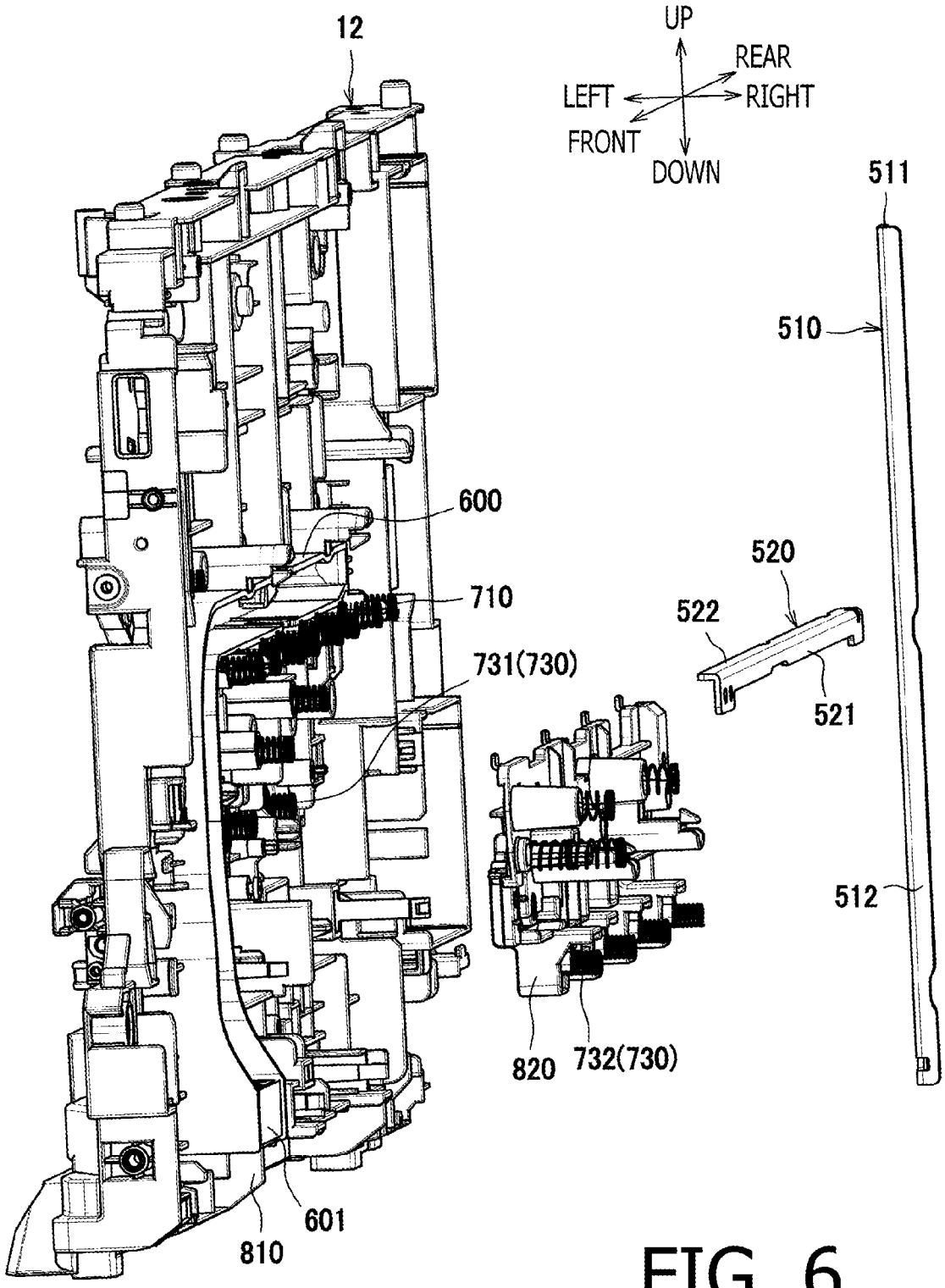
FIG. 6 is an exploded perspective view of the right-side frame, a subsidiary frame, first and second metal beams in the color printer according to the embodiment of the present invention.

As shown in FIGS. 5 and 6, the first metal beam 510, made of metal, is formed in a shape of an elongated bar longitudinally arranged along the vertical direction. The first metal beam 510 may be made of, but not limited to, iron. The first metal beam 510 is arranged along a planar face of the right-side frame 12, which includes the flat surfaces 121A of the flat parts 121, and fixed to the outer side of the right-side frame 12 along the widthwise direction. With the first metal beam 510, the resin-made right-side frame 12 is enhanced at the side; therefore, for example, compared to a right-side frame configured with resin only, the right-side frame 12 with improved rigidity may be provided.

The first metal beam 510 is formed in a shape of a bar having shorter sides and longer sides in a lateral view along the widthwise direction. In this regard, the shorter sides align with the front-rear direction of the right-side frame 12, and a dimension of the shorter sides is substantially smaller with respect to a dimension of the right-side frame 12 along the front-rear direction. In particular, the dimension of the shorter sides of the first metal beam 510 along the front-rear direction is approximately at most 1/47 of the dimension of the right-side frame 12 along the front-rear direction. With the substantially smaller dimension with respect to the dimension of the resin-made right-side frame 12 along the front-rear direction, a weight of the color printer 1 can be reduced to be less compared to, for example, the conventional printer with a side frame consisting of a larger metal plate with planar dimension. The dimension of the first metal beam 510, at a largest part, along the front-rear direction may be between 1/10 and 1/100 with respect to the dimension of a largest part of the right-side frame 12 along the front-rear direction, and it may even be preferable to set the ratio within a range between 1/40 and 1/50.

The first metal beam 510 is arranged to vertically penetrate through a duct 600, which is arranged on the right-side frame 12. An upper end portion 510A of the first metal beam 510 is fixed to an upper part of the right-side frame 12 and to the L-shaped metal piece 300 while a lower end portion 510B of the first metal beam 510 is engaged with a lower part of the right-side frame 12. The duct 600 provides an air channel for the air, which is introduced by a fan 601 and conveyed to the processing units 50.

Figure 7:
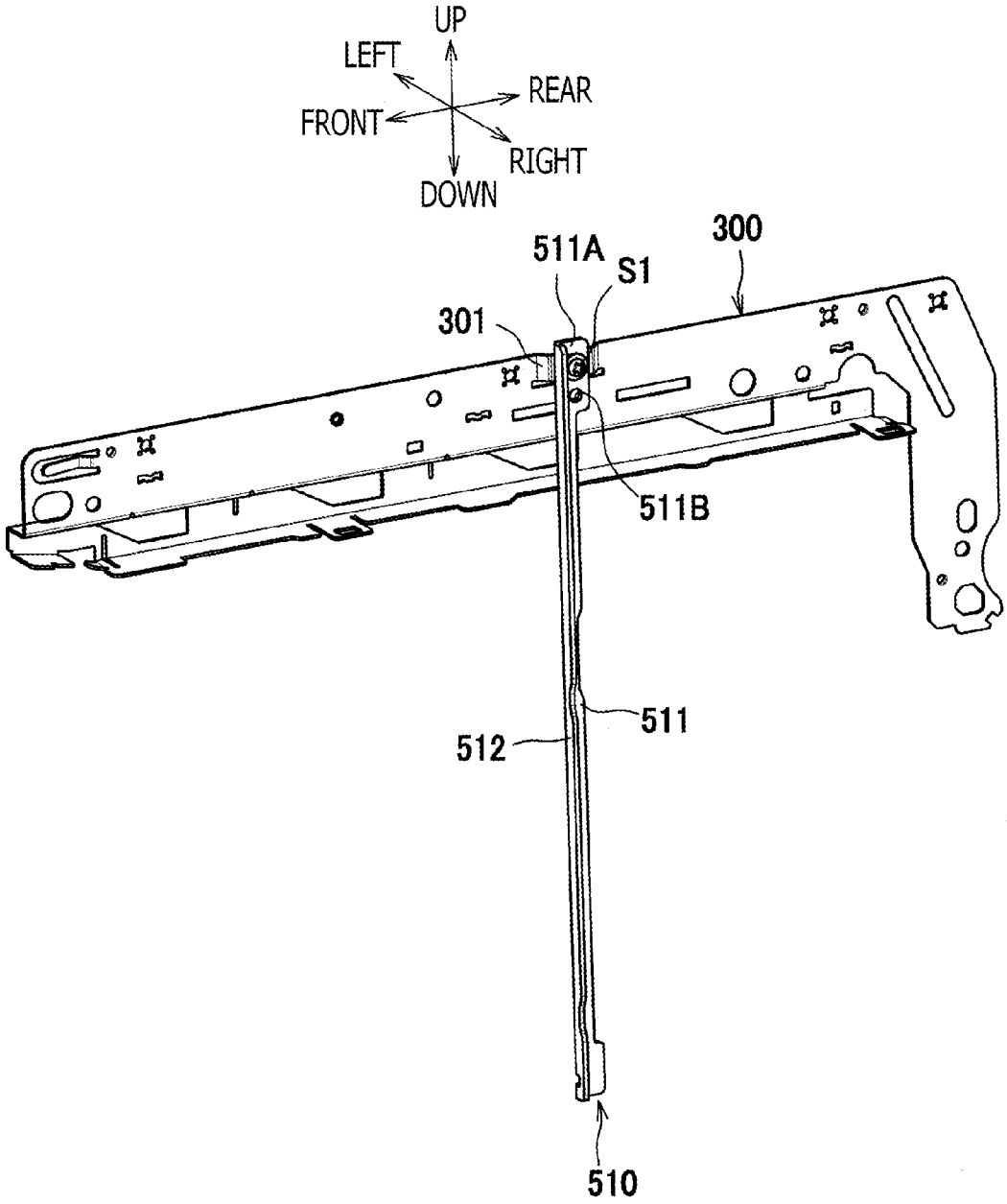
FIG. 7 is a perspective view of the L-shaped metal piece and a first metal beam in the color printer according to the embodiment of the present invention.

As shown in FIG. 7, the first metal beam 510 is formed of an elongated thin metal bar bent along the longitudinal direction to form a cross-sectional shape of an L. The first metal beam 510 includes a first section 511, which spreads orthogonally to the widthwise direction, and a second section 512, which spreads from a front end of the first section 511 outward along the widthwise direction. The first section 511 is formed to have two openings 511B, which align along the vertical direction, in an upper-end portion 511A of the first section 511. In an upper one of the openings 511B, a screw S1 to fasten the first metal beam 510 to one of the L-shaped metal pieces 300 on the right is inserted.

More specifically, in the L-shaped metal piece 300, a bulge 301 protruding outward along the widthwise direction is formed. As shown in FIGS. 5 and 7, the bulge 301 is arranged to protrude outward along the widthwise direction with respect to the flat part 121 through an opening (unsigned) formed in the flat part 121 of the right-side frame 12. While the upper-end portion 511A of the first section 511 of the first metal beam 510 is placed over the bulge 301, the screw S1 is inserted through the upper opening 511B in the upper-end portion 511A and screwed to the L-shaped metal piece 300. Thereby, the first metal beam 510 is fixed to the L-shaped metal piece 300 at the upper-end portion 511A of the first section 511. In this regard, the right-side frame 12 is interposed between the L-shaped metal piece 300, which is arranged on the inner side of the right-side frame 12, and the first metal beam 510, which is arranged on the outer side of the right-side frame 12.

Meanwhile, in a lower one of the openings 511B formed in the upper-end portion 511A of the first section 511, a boss 127 formed in the right-side frame 12 is inserted to place the first metal beam 510 in a correct position with respect to the right-side frame 12. In other words, by inserting the boss 127 of the right-side frame 12 into the lower one of the openings 511B in the upper-end portion 511A, the upper-end portion 511A of the first section 511 is placed in the correct position with respect to the right-side frame 12.

Figure 8A:
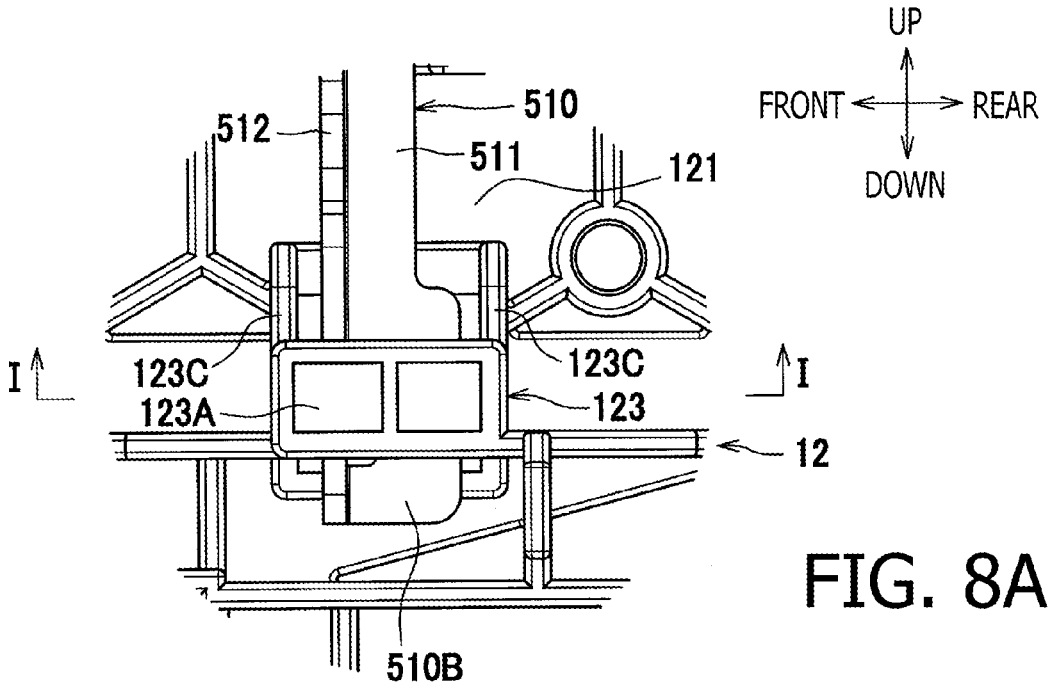
FIG. 8A is an enlarged view of a lower part of the first metal beam and a first engageable part in the color printer according to the embodiment of the present invention.
Figure 8B:
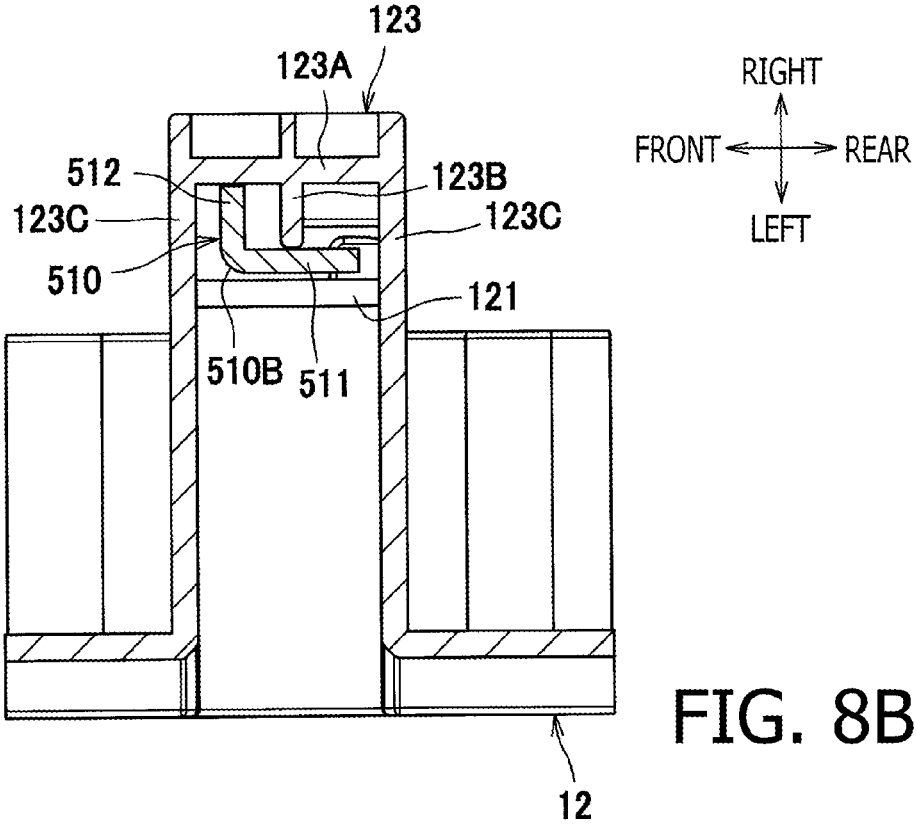
FIG. 8B is a cross-sectional view of the lower part of the first metal beam and the first engageable part in the color printer according to the embodiment of the present invention taken along a line I-I shown in FIG. 8A.

The lower end portion 510B of the first metal beam 510 is engaged with a first engageable part 123 formed in the right-side frame 12. As shown in FIGS. 8A and 8B, the first engageable part 123 includes a first engageable block 123A, a second engageable block 123B, and paired connecting blocks 123C. The first engageable block 123A is arranged on a right-hand side, i.e., an outer side, of the second section 512 of the first metal beam 510 along the widthwise direction and is engageable with the edge of the second section 512. The second engageable block 123B is arranged to extend leftward, i.e., inward along the widthwise direction, from a center of the first engageable block 123 along the front-rear direction to be engageable with the first section 511 of the first metal beam 510. The paired connecting blocks 123C are arranged to extend leftward from front and rear ends of the first engageable block 123A to be connected to the flat part 121 of the right-side frame 12.

The lower end portion 510B of the first metal beam 510 is placed in a position between the first and second engageable blocks 123A, 123B, and the flat part 121 along the widthwise direction. Thus, the lower end portion 510B of the first metal beam 510 is restricted from moving in the widthwise direction. In this regard, the lower end portion 510B of the first metal beam 510 is arranged to protrude downward from the first engageable part 123.

Therefore, while a thermal expansion rate of the resin-made right-side frame 12 is generally greater than a thermal expansion rate of the metal-made first metal beam 510, the lower end portion 510B of the first metal beam 510 is prevented from being disengaged from the first engageable part 123.

Meanwhile, the lower end portion 510B of the first metal beam 510 is engaged with the first engageable part 123, in a lower area with respect to the lower end portion 510B of the first metal beam 510, and a clearance to absorb the difference in the thermal expansion rates is reserved. Thereby, even when the right-side frame 12 is thermally contracted, the lower end portion 510B is prevented from being in conflict with by another part of the body 10 or other components in the color printer 1.

As shown in FIGS. 5 and 6, the second metal beam 520 is in a structure similar to the first metal beam 510. Therefore, the second metal beam 520 includes a first section 521 and a second section 522, which are similar to the first section 511 and the second section 512 of the first metal beam 510. The second metal beam 520 is arranged on an inner side with respect to the first metal beam 510 along the widthwise direction. The second metal beam 520 is fixed to the right-side frame 12 and arranged to extend longitudinally along the front-rear direction, orthogonally to the first metal beam 510. More specifically, the second metal beam 520 and the first metal beam 510 are arranged to overlap each other at longitudinal center portions thereof, when viewed laterally along the widthwise direction, to intersect crosswise with each other. With the intersecting first and second metal beams 510, 520, the rigidity of the right-side frame 12 can be improved even more.

The second metal beam 520 is arranged in an orientation to have the first section 521 to extend orthogonally to the widthwise direction, more specifically, along the flat surfaces 121A of the flat surfaces 121A of the flat parts 121 in the right-side frame 12, in an orientation, in which an edge of the second section 522 faces inward (leftward) along the widthwise direction. In other words, the edge of the second section 512 of the first metal beam 510 and the edge of the second section 522 of the second metal beam 520 face opposite directions from each other along the widthwise direction. Therefore, flat surfaces of the first section 511 in the first metal beam 510 and the first section 521 in the second metal beam 520 are placed in close contact with each other. Accordingly, the second beam 520 can be firmly held in the position between the first metal beam 510 and the right-side frame 12 while the second metal beam 520 is restricted from being distorted.

Figure 9A:
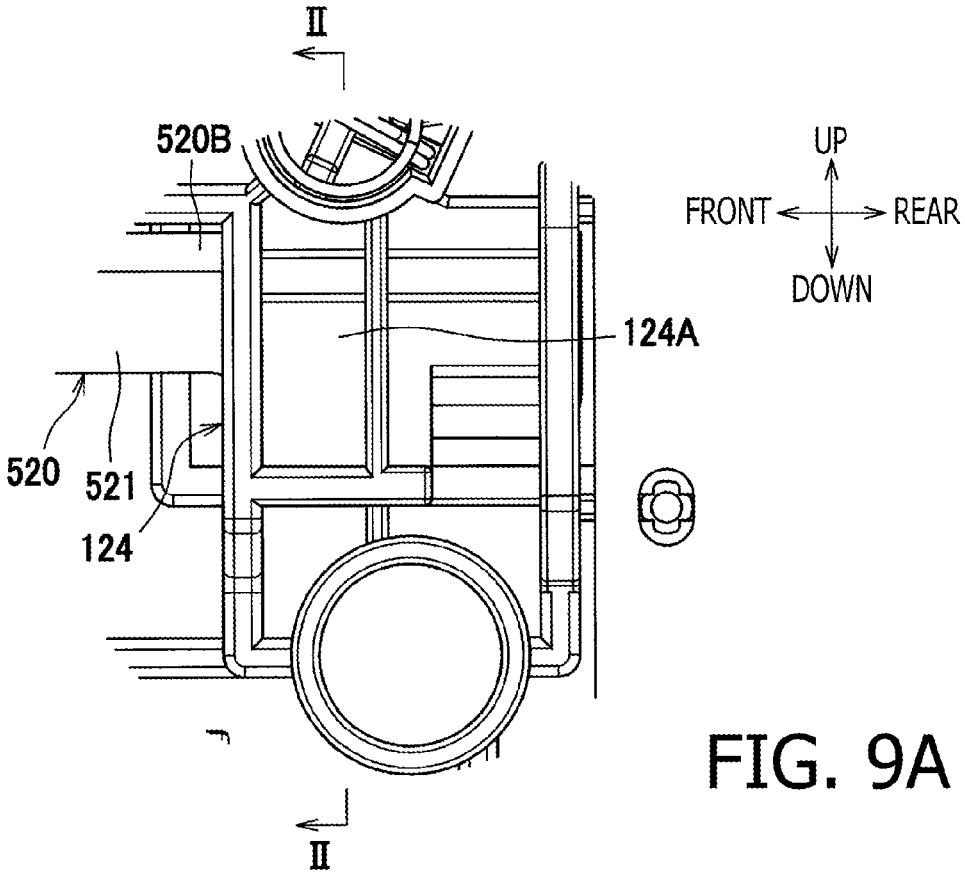
FIG. 9A is an enlarged view of a rear part of a second metal beam and a second engageable part in the color printer according to the embodiment of the present invention.
Figure 9B:
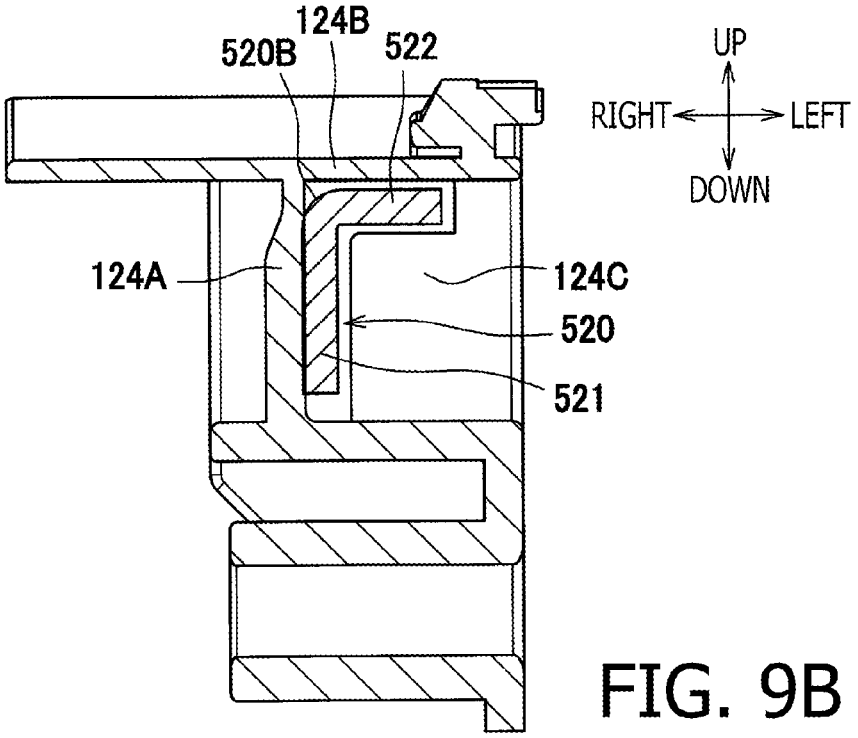
FIG. 9B is a cross-sectional view of the rear part of the second metal beam and the second engageable part in the color printer according to the embodiment of the present invention taken along a line II-II shown in FIG. 9A.

The second metal beam 520 is fixed to the right-side frame 12 at a front-end tab 520A while a rear end 520B of the second metal beam 520 is engaged with a second engageable part 124 formed in the right-side frame 12. As shown in FIGS. 9A and 9B, the second engageable part 124 includes a first restrictive block 124A, a second restrictive block 124B, and a third restrictive block 124C. The first restrictive block 124A is arranged on a right-hand side, i.e., the outer side, of the second metal beam 520 along the widthwise direction. The second restrictive block 124B is arranged in an upper position with respect to the second metal beam 520. The third restrictive block 124C is arranged on a left-hand side, i.e., an inner side, of the second metal beam 520.

The third restrictive block 124C is formed to have a right-side end thereof to fit with the shape of the second metal beam 520. Therefore, the second metal beam 520 is restricted by the first restrictive block 124A and the third restrictive block 124C from being moved in the widthwise direction while the second section 522 of the second metal beam 520 is restricted from being moved vertically by the second restrictive block 124B and the third restrictive block 124.

While the rear end 520B of the second metal beam 520 is engaged with the second engageable part 124, in a rearward area with respect to the rear end 520B of the second metal beam 520, a clearance to absorb the difference in the thermal expansion rates is reserved. Thereby, even when the right-side frame 12 is thermally contracted, the rear end 520B is prevented from being in conflict with another part of the body 10 or other components in the color printer 1.

The arrangement of the first metal beam 510 and the second metal beam 520 will be described in detail hereinbelow.

Figure 10:
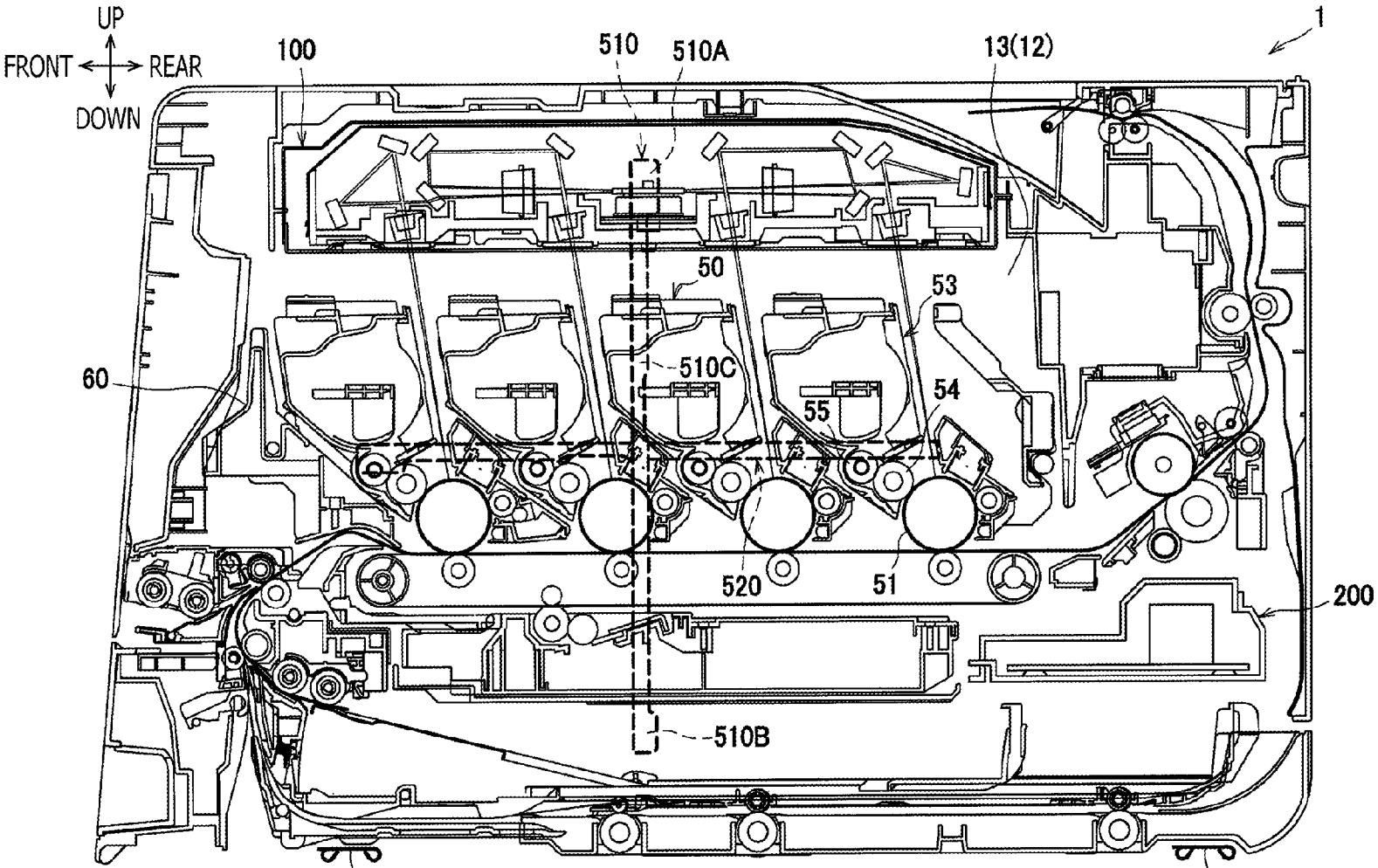
FIG. 10 is a cross-sectional side view of the color printer with the first and second metal beams and processing units according to the embodiment of the present invention.

As shown in FIG. 10, the first metal beam 510 overlaps at least one of the processing units 50 at a longitudinal central part 510C in a perspective view laterally projected along the widthwise direction. In this regard, the upper end portion 510A and the lower end portion 510B of the first metal beam 510 are located in vertically outer side areas with respect to the processing units 50. Therefore, a force applied from the processing units 50 to the right-side frame 12, in particular, a force applied to a part of the right-side frame 12 which supports the drawer 60, can be borne by the first metal beam 510 rigidly.

The upper end portion 510A of the first metal beam 510 is arranged to overlap the first connecting frame 100 in the perspective view projected laterally along the widthwise direction. In this arrangement, deformation of the first metal beam 510 in the widthwise direction can be restricted by the first connecting frame 100, and the rigidity of the right-side frame 12 may be enhanced even more.

In other words, the upper end portion 510A of the first metal beam 510 is fixed to a more rigid part of the right-side frame 12, i.e., a connected area where the right-side frame 12 is connected with the first connecting frame 100, than other less rigid parts. Therefore, while the second metal beam 520 is supported by the first metal beam 510, which is fixed to the more rigid part and is more difficult to deform, the second metal beam 520 can be restricted from being deformed more effectively. Accordingly, the rigidity of the right-side frame 12 may be enhanced even more.

Further, the second metal beam 520 is arranged to overlap the drawer 60 in the perspective view projected laterally along the widthwise direction. In this regard, while the drawer 60 should be movably supported by the side frames 12, 13 to move with respect to the body 10 of the color printer 1, the movable area for the drawer 60, needs to be from the first and second connecting frames 100, 200. Meanwhile, with the second metal beam 520 arranged to overlap the drawer 60 in the perspective view projected laterally along the widthwise direction, the part of the right-side frame 12 corresponding to the movable area for the drawer 60 can be enhanced by the second metal beam 520.

While the second metal beam 520 is made of iron and formed to have a thickness of, for example, 1.6 mm, the first metal beam 510 is formed to be more rigid than the second beam 520. The rigidity of the first metal beam 510 may be enhanced to be higher than the rigidity of the second metal beam 520 by, for example, being formed to be thicker than the second metal beam 520 or by being formed in a more rigid material than iron such as stainless steel. In this regard, the rigidity of the metal beams should mean difficulty in deformation. For example, the rigidity of the first and second metal beams 510, 520 may be determined by bendable amounts of the first metal beam 510 and the second metal beam 520 when a same intensity of load is equally applied to the first and second metal beams 510, 520.

When, for example, the color printer 1 falls down from a higher place and is subject to a certain amount of load, the drawer 60 may be urged against the right-side frame 12, and the right-side frame 12 may tend to deform at an area in the vicinity of the second metal beam 520. However, with the rigidity difference between the first metal beam 510 and the second metal beam 520, the deformation around the second metal beam 520 may be restricted by the first metal beam 510, of which rigidity is higher than the rigidity of the second metal beam 520.

As mentioned above, the first metal beam 510 with the higher rigidity is arranged on the side opposite from the plurality of processing units 50 across the second metal beam 520 to contact the second metal beam 520. Therefore, when, for example, the color printer 1 falls down from a higher place and is subject to a certain amount of load, the load may be transmitted through the second metal beam 520, which extends along the aligning direction of the plurality of processing units 50, to the first metal beam 510, of which rigidity is higher than the second metal beam 520. Therefore, the load may be effectively absorbed in the first and second metal beams 510, 520 so that deformation of the right-side frame may be effectively prevented.

Figure 11:
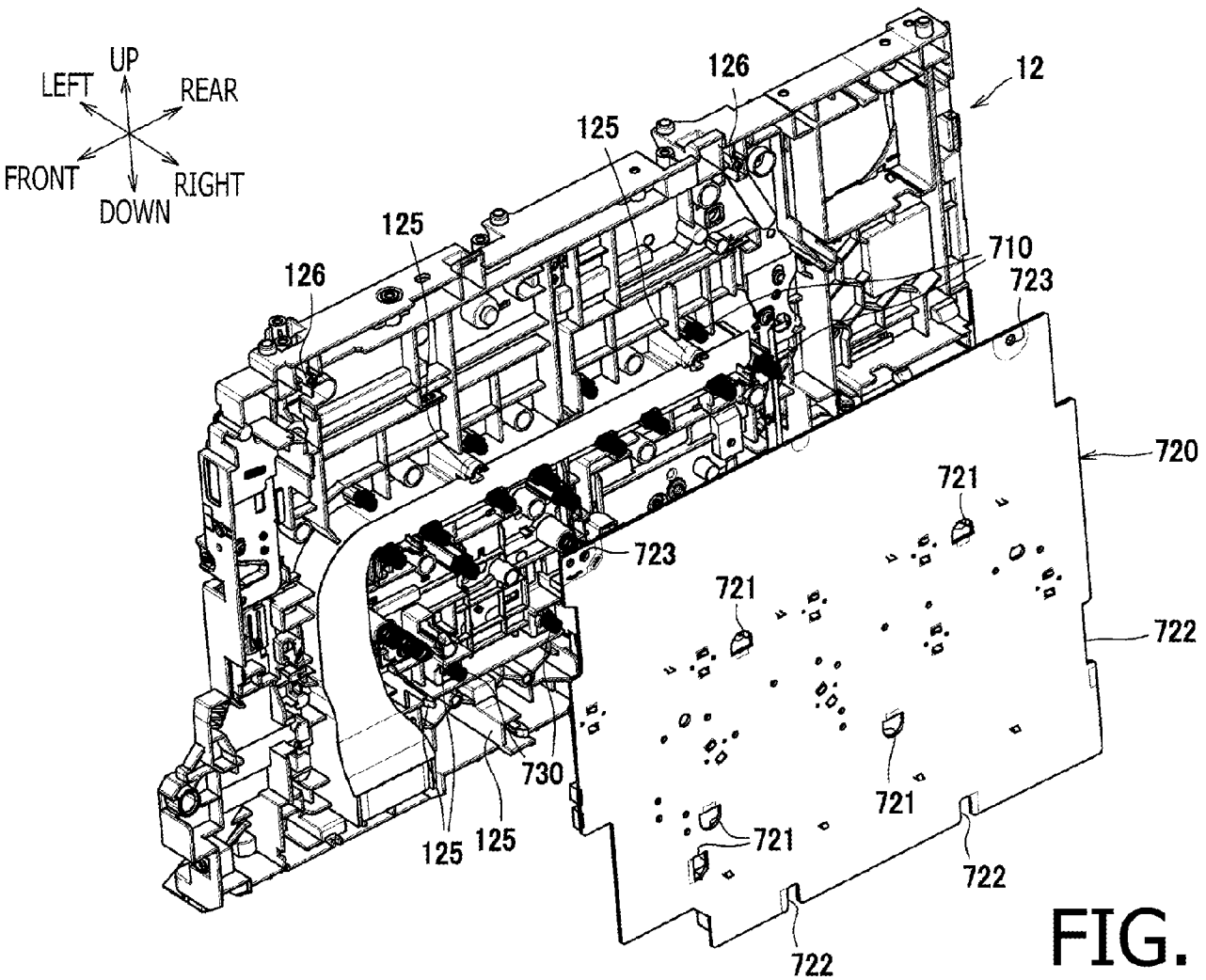
FIG. 11 is an exploded perspective view of spring electrodes and a substrate in the color printer according to the embodiment of the present invention.

As shown in FIG. 11, while the right-side frame 12 is enhanced by the first and second metal beams 510, 520, resilient forces from a plurality of spring electrodes 710, which supply power to the processing units 50, and a plurality of spring electrodes 730, which supply power to the transfer unit 70, are applied to the right-side frame 12 enhanced by the first and second metal beams 510, 520. More specifically, on the outer side of the right-side frame 12 along the widthwise direction, a substrate 720 is arranged. The substrate 720 converts the electricity supplied from the power board 400 (see FIG. 1) into suitable electricity and distributes the converted electricity to the processing units 50 and the transfer unit 70 via the spring electrodes 710, 730. With the substrate 720 arranged on the outer side of the right-side frame 12 along the widthwise direction, it is noted that the drawer 60 is prevented from being interfered with by the substrate 720 when the drawer 60 is moved into or out of the body 10 of the color printer 1.

The right-side frame 12 includes a plurality of substrate supports 125, 126 to support the substrate 720 on the outer side thereof, i.e., on the opposite side from the processing units 50, along the widthwise direction (see also FIG. 5). Each of the substrate supports 125 has a claw (unsigned), which is deformable along the direction orthogonal to the widthwise direction. The substrate supports 125 support the substrate 720 by placing the claws engaged with openings 721 and cutouts 722 formed in the substrate 720. In upper positions in the substrate 720, through holes 723 are formed, and screws penetrating through the through holes 723 are fastened to the substrate supports 126. Thus, the substrate supports 126 support the substrate 720 by the fastening.

Figure 12:
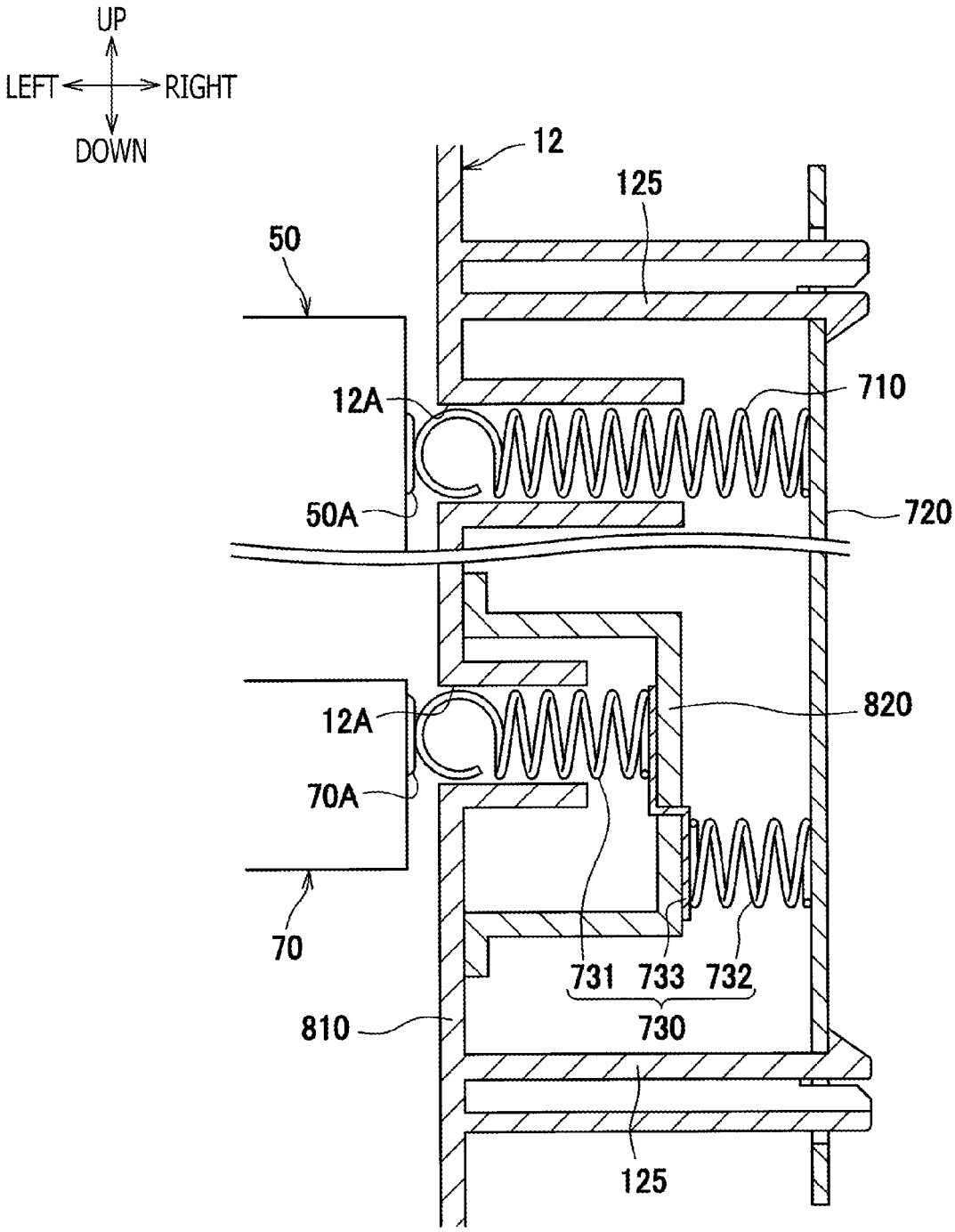
FIG. 12 is a cross-sectional view of the right-side frame with the spring electrodes and the substrate in the color printer according to the embodiment of the present invention.

As illustrated in FIG. 12, the spring electrodes 710 are arranged in upper positions with respect to the spring electrodes 730. Each of the spring electrodes 710 includes a compressed coiled spring and is supported by the right-side frame 12 in a compressed condition to be resiliently urged against one of electrodes 50A of the processing units 50. The spring electrodes 710 may be, but not limited to, directly in contact with the electrodes 50A of the processing units 50. For example, the spring electrodes 710 may be in indirectly contact with the electrodes of the processing units 50 via intermediate conductors arranged on the drawer.

The spring electrodes 730 are arranged in lower positions with respect to the spring electrodes 710. Each of the spring electrodes 730 includes a first spring electrode 731, a second spring electrode 732, and an intermediate conductor 733. The first spring electrode 731 is connected with an electrode 70A of the transfer unit 70, and the second spring electrode 732 is connected with the substrate 720. The intermediate conductor 733 connects the first spring electrode 731 and the second spring electrode 732 with each other.

The first spring electrode 731 is a compressed coiled spring electrode and is supported by the right-side frame 12 in a compressed condition to be resiliently urged against one of the electrodes 70A of the transfer unit 70. More specifically, while the right-side frame 12 includes a main frame 810 and a subsidiary frame 820, which is fixed to an outer side of the main frame 810 (see also FIG. 6), the first spring electrode 731 is arranged in between the transfer unit 70 and the subsidiary frame 820.

The intermediate conductor 733 is arranged to penetrate through the subsidiary frame 820 along the widthwise direction.

The second spring electrode 732 is a compressed coiled spring electrode and is supported by the subsidiary frame 820 in a compressed condition in between the intermediate conductor 733 and the substrate 720.

With the spring electrodes 710, 730 with resiliency, the spring electrodes 710, 730 can be connected to the processing units 50, the transfer unit 70 and to the substrate 720 steadily. Further, the processing units 50 can be restricted from being moved in the widthwise direction with respect to the right-side frame 12. While the resilient force from the spring electrodes 710, 730 is applied to the right-side frame 12, with the first and second metal beams 510, 520 enhancing the right-side frame 12, the rigidity of the right-side frame 12 can be enhanced, and deformation of the right-side frame 12 can be restricted.

In the right-side frame 12, a plurality of holes 12A, in which the spring electrodes 710, 730 are inserted to be supported, are formed along a direction of thickness (i.e., the widthwise direction). While the holes 12A may decrease intensity of the right-side frame 12, with the first and second metal beams 510, 520 enhancing the right-side frame 12, the rigidity of the right-side frame 12 can be maintained or enhanced, and deformation of the right-side frame 12 can be restricted.

The spring electrodes 710 include, as shown in FIG. 5, four (4) electrodes 710A for wires, four (4) electrodes 710B for developers, four (4) electrodes 710C for grids, and two (2) electrodes 710D for drums. The electrodes 710A for wires are electrodes to supply electricity to the charging wires 52A. Each of the charging wires 52A is provided with one of the electrodes 710A, and the electrodes 710A as well as the charging wires 52A are arranged at equal intervals from one another to align along the front-rear direction.

The electrodes 710B for developers are electrodes to supply electricity, more specifically, developer bias, to the developer cartridges 53. Each of the developer cartridges 53 is provided with one of the electrodes 710B, and the electrodes 710B as well as the developer cartridges 53 are arranged at equal intervals from one another to align along the front-rear direction. More specifically, each of the electrodes 710B supplies electricity to the developer roller 54 and the supplier roller 55 in one of the developer cartridges 53. The electrodes 710C for grids are electrodes to supply electricity to the grid electrodes 52B. Each of the grid electrodes 52B is provided with one of the electrodes 710C, and the electrodes 710C as well as the grid electrodes 52B are arranged at equal intervals from one another to align along the front-rear direction. The electrodes 710D for drums are electrodes to supply electricity to the photosensitive drums 51 and are arranged in lower positions with respect to the electrodes 710C for grids.

The spring electrodes 730 supply electricity, more specifically, transfer bias, to the transfer rollers 74. Each of the transfer rollers 74 is provided with one of the spring electrodes 730, and the spring electrodes 730 as well as the transfer rollers 74 are arranged at equal intervals from one another to align along the front-rear direction. The first metal beam 510 is arranged in a position between two electrodes in midst positions along the front-rear direction among the four electrodes (e.g., the electrodes 710A for wires), which share the electricity from the same source.

Figure 13:
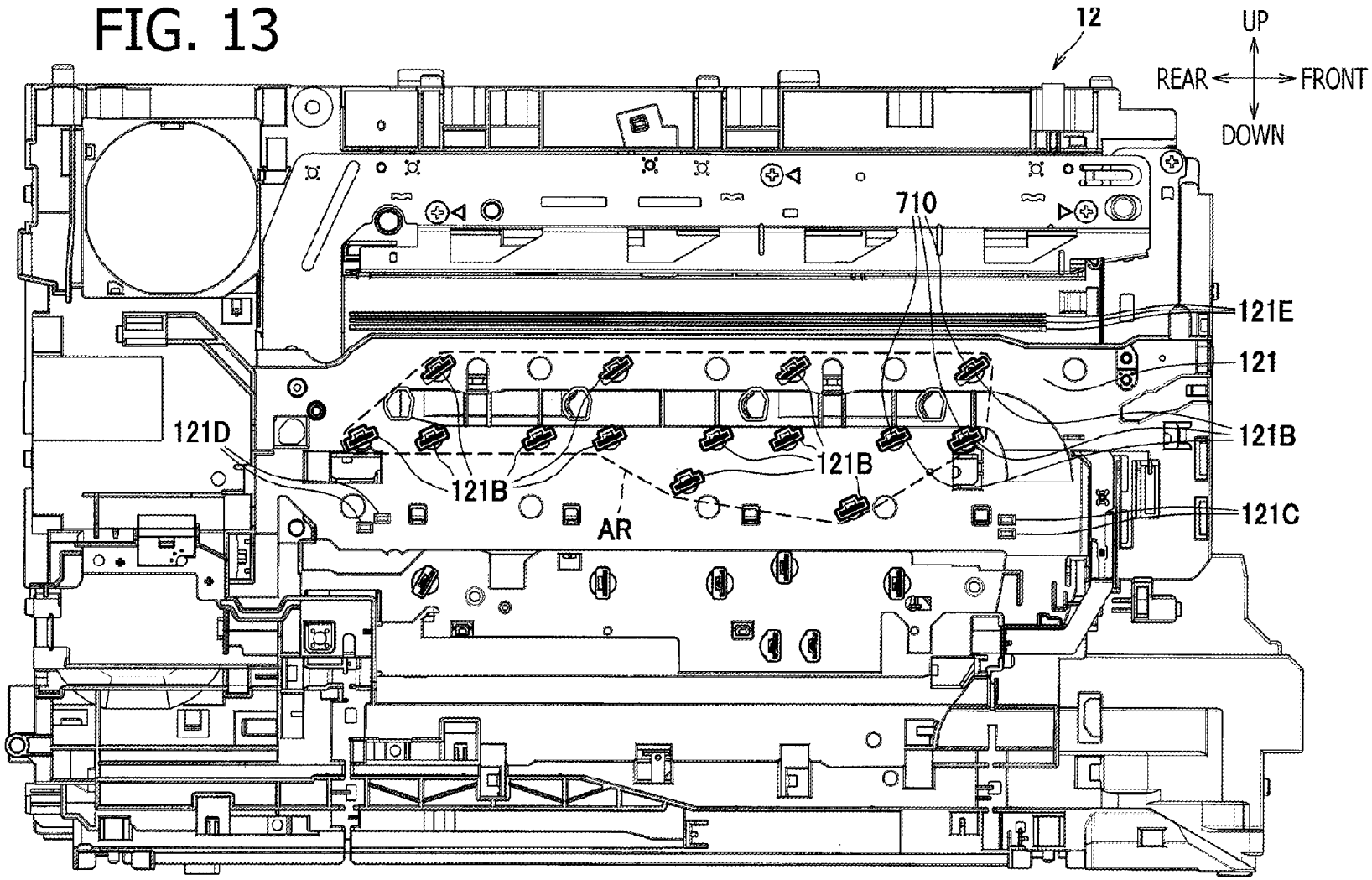
FIG. 13 is a lateral view of the right-side frame in the color printer according to the embodiment of the present invention viewed from an inner side along the widthwise direction.
Figure 14:
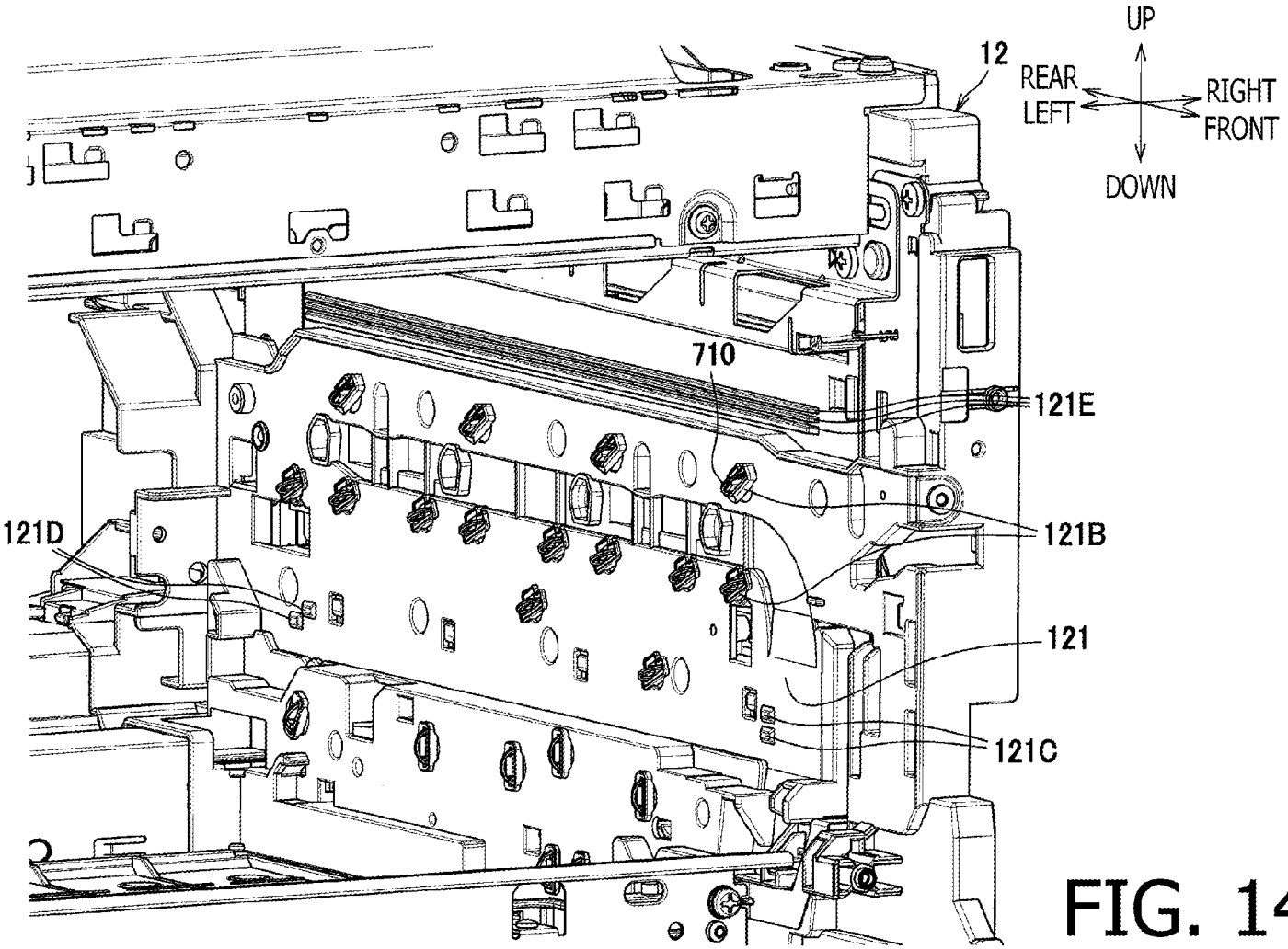
FIG. 14 is a perspective view of the right-side frame in the color printer according to the embodiment of the present invention viewed from the inner side along the widthwise direction.

As shown in FIGS. 13 and 14, on the inner side of the right-side frame 12, arranged are a plurality of support projections 121B, first projections 121C, second projections 121D, and third projections 121E. The plurality of support projections 121B are formed to protrude from the inner surface of the flat parts 121 inwardly to support the spring electrodes 710. The first projections 121C, the second projections 121D, and the third projections 121E are arranged to contact the drawer 60 when the drawer 60 is moved toward the right-side frame 12. In other words, when the drawer 60 is moved toward the right-side frame 12, portions in the right-side frame 12 that should first come into contact with the drawer 60 are the first, second, and third projections 121C-121E, whereas the remainder of the right-side frame 12 should contact the drawer 60 either at the same time as the first, second, and third projections 121C-121E or later.

The first projections 121C, the second projections 121D, and the third projections 121E are arranged in positions on the outer side with respect to the plurality of support projections 121B along the widthwise direction and in positions to overlap the drawer 60 when viewed along the widthwise direction. More specifically, the first, second, and third projections 121C-121E are arranged outside a surrounded area AR, which is indicated by a broken line in FIG. 13. The surrounded area AR is an area enclosed by lines connecting outer peripheries of the support projections 121B. More specifically, the surrounded area AR is an area enclosed by straight lines contacting the outer peripheries of the support protrusions 121B and lines drawn along the outer peripheries of the support protrusions 121B.

The first projections 121C include two (2) first projections 121C, which are arranged to align vertically in lower-frontward positions with respect to the surrounded area AR apart from the surrounded area AR. In other words, the first projections 121C are in frontward positions with respect to the plurality of support projections 121B along the front-rear direction, more specifically, in positions closer to the front end of the right-side frame 12 than the plurality of support projections 121B. Therefore, when, for example, the color printer 1 falls from a higher place, the drawer 60 may be moved toward the right-side frame 12 and contact the first projections 121C. In this regard, impact from the drawer 60 transmitted to the right-side frame 12 is received at a front end portion of the right-side frame 12, which is a part rather difficult to be deformed within the right-side frame 12. Therefore, compared to a configuration, in which the impact from the drawer when the color printer falls is received at a central part of the right-side frame, an amount of deformation of the resin-made right-side frame 12 may be restrained to be smaller.

Further, the first projections 121C on the positions described above are arranged to contact the front end portion of the drawer 60 when the drawer 60 moves along the widthwise direction. Therefore, for example, compared to a configuration, in which the first projections are arranged to contact a central portion of the drawer rather than the front end portion, a deformation amount of the right-side frame 12 may be restrained to be even smaller.

The second projections 121D include two (2) second projections 121D arranged in lower positions with respect to a rear part of the surrounded area AR apart from the surrounded area AR. One of the second projections 121D is in an upper-frontward position with respect to the other. In these positions, the second projections 121D are arranged to contact a rear end portion of the drawer 60 when the drawer 60 moves along the widthwise direction. Thus, the first projections 121C and the second projections 121D are in positions to contact the end portions of the drawer 60 along the front-rear direction respectively. Therefore, the load from the drawer 60, transmitted from the front and rear end portions of the drawer 60, can be distributed in the right-side frame 12 through the first and second projections 121C, 121D. Accordingly, the deformation amount of the right-side frame 12 may be restrained to be even smaller.

The third projections 121E include three (3) third projections 121E, which are arranged to align vertically in upper apart positions with respect to the surrounded area AR to be in contact with an upper end portion of the drawer 60 when the drawer 60 moves along the widthwise direction. Thus, the load from the drawer 60 can be distributed in the first-third projections 121C-121E so that the deformation amount of the right-side frame 12 may be restrained to be even smaller.

In this regard, each of the third projections 121E is formed in a shape of a rib elongated along the front-rear direction. Therefore, the load from the drawer 60 can be distributed in the elongated area containing the third projections 121E so that the deformation of the right-side frame 12 may be restrained even more effectively. A length of each third projection 121E may be, for example, 254.2 mm.

Figure 15B:
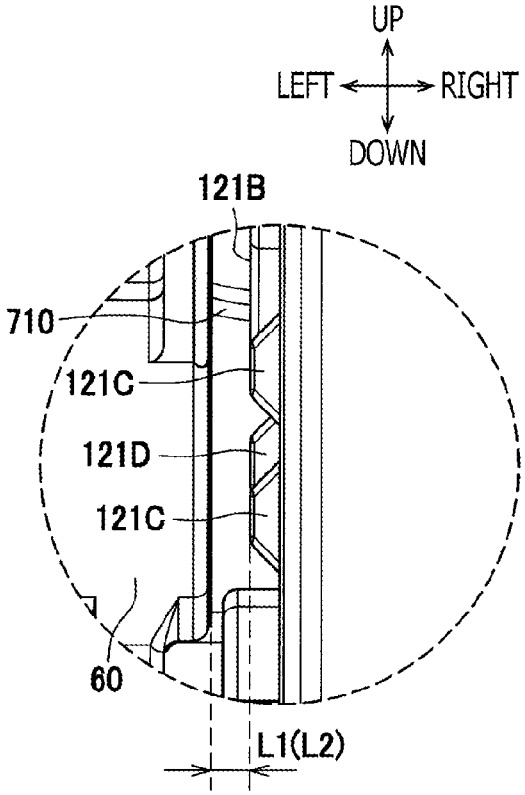
FIG. 15B is an enlarged partial view of an area indicated by a sign III in FIG. 15A according to the embodiment of the present invention.
Figure 15A:
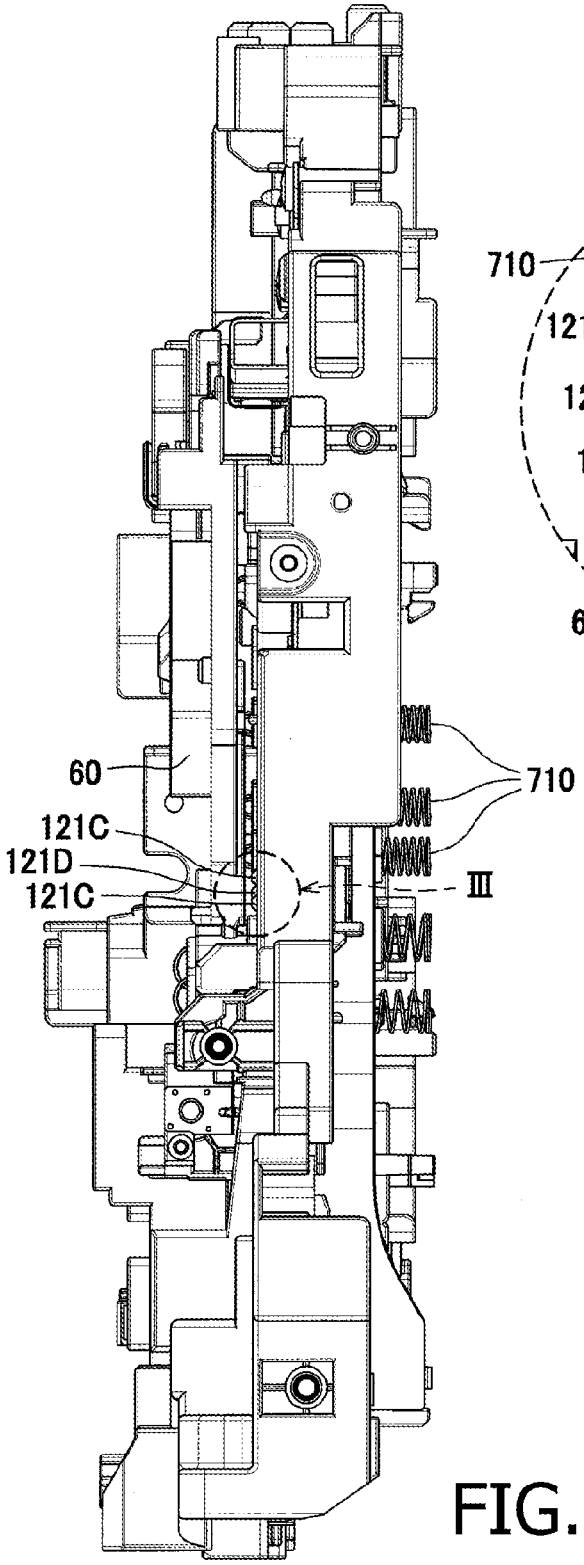
FIG. 15A is a front view of the right-side frame in the color printer according to the embodiment of the present invention viewed along a front-rear direction.

As shown in FIGS. 15A and 15B, widthwise ends of the first-third projections 121C-121E on the inner side align with widthwise ends of the support projections 121B on the inner side (the third projections 121E are not shown in FIGS. 15A-15B). In other words, a first amount L1 of clearance between the first-third projections 121C-121E and the drawer 60 is equal to a second amount L2 of clearance between the support projections 121B and the drawer 60. The first amount L1 and the second amount L2 may be, for example, 1.3 mm.

Thereby, the impact from the drawer 60 falling down may be dispersed to the first-third projections 121C-121E and the support projections 121B. Accordingly, deformation of the right-side frame 12 may be moderated or prevented. In particular, while the drawer 60 is in the elongated form to be longer in the front-rear direction than in the vertical direction, the drawer 60 may contact the projections arranged on the side closer to the edge of the right-side frame 12, such as the first projections 121C, than the support projections 121B more easily. Therefore, the impact from the drawer 60 may not fall only on the support projections 121B but may be distributed, and reaction force may be prevented from concentrating on the central part of the right-side frame 12 so that an amount of distortion may be reduced.

It is to be noted that the first amount L1 of clearance between the first-third projections 121C-121E and the drawer 60 may not necessarily be equal to the second amount L2 of clearance between the support projections 121B and the drawer 60 but may be smaller. Even in this configuration, the first-third projections 121C-121E should contact the drawer 60 earlier than the support projections 121B, and the impact from the drawer 60 may be transmitted to the edge portions of the right-side frame 12, which are more difficult to deform than the central portion. Therefore, the amount of distortion in the right-side frame 12 may be reduced. The first amount L1 of the clearance between the first-third projections 121C-121E and the drawer 60 along the widthwise direction may be, for example, 1.3 mm.

According to the embodiment described above, further to the effectiveness having been mentioned above, while the first and second metal beams 510, 520 have the first section 511 and the first section 521, which overlap each other along the widthwise direction, the first and second metal beams 510, 520 are stably attached to the right-side frame 12 via the first section 511 and the first section 521. Further, with the first sections 511, 521 of the first and second metal beams 510, 520, the rigidity of the metal beams 510, 520 can be increased.

Although an example of carrying out the invention has been described, those skilled in the art will appreciate that there are numerous variations and permutations of the color printer that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

Different embodiments of the present invention will be described below. In the different embodiments, items or structures which are the same as or similar to items or structures described in the previous embodiment will be referred to by the same reference signs, and description of those will be omitted.

Figure 16:
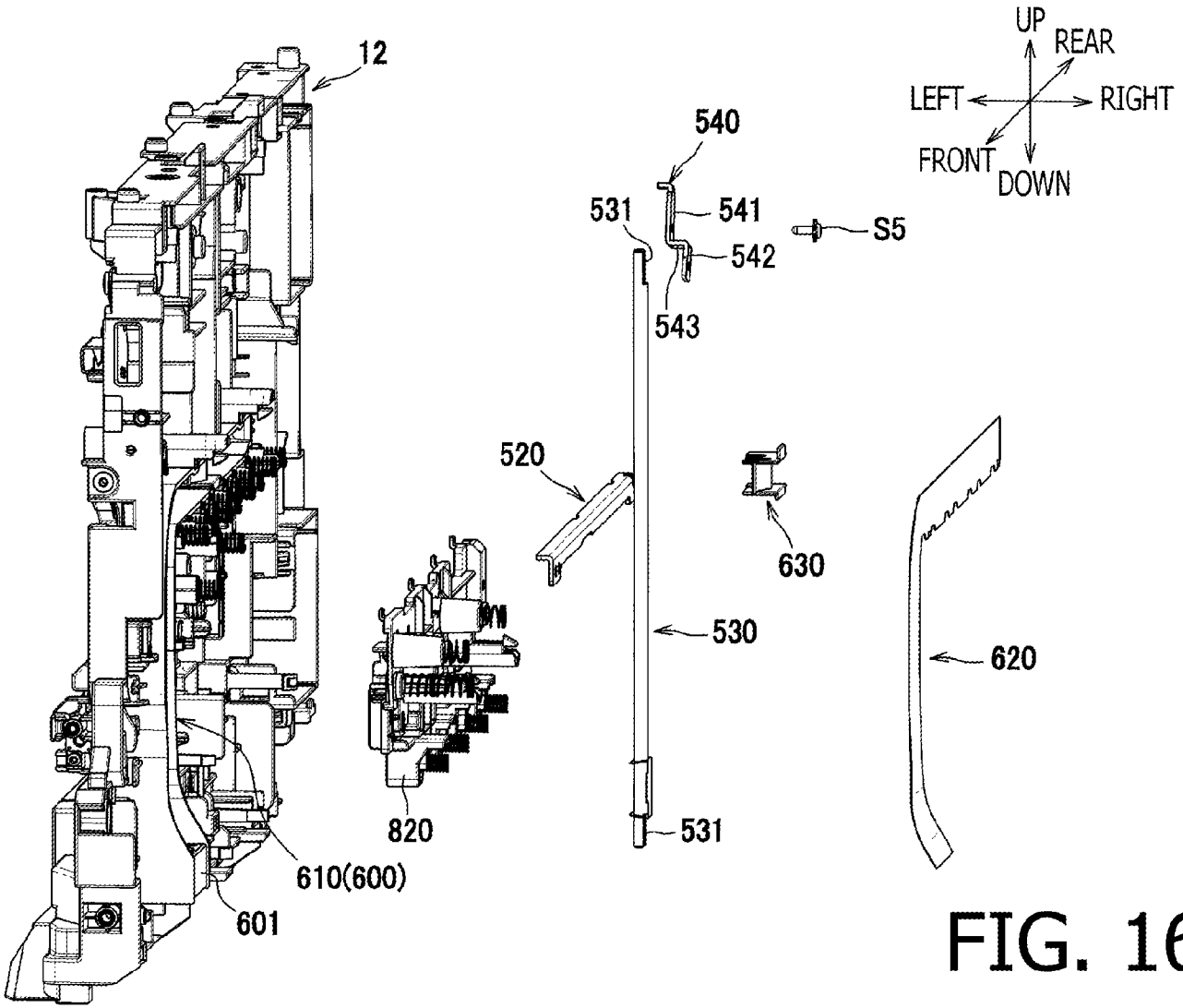
FIG. 16 is an exploded perspective view of the right-side frame, a subsidiary frame, first and second beams, and accompanying parts in the color printer according to a second embodiment of the present invention.
Figure 17:
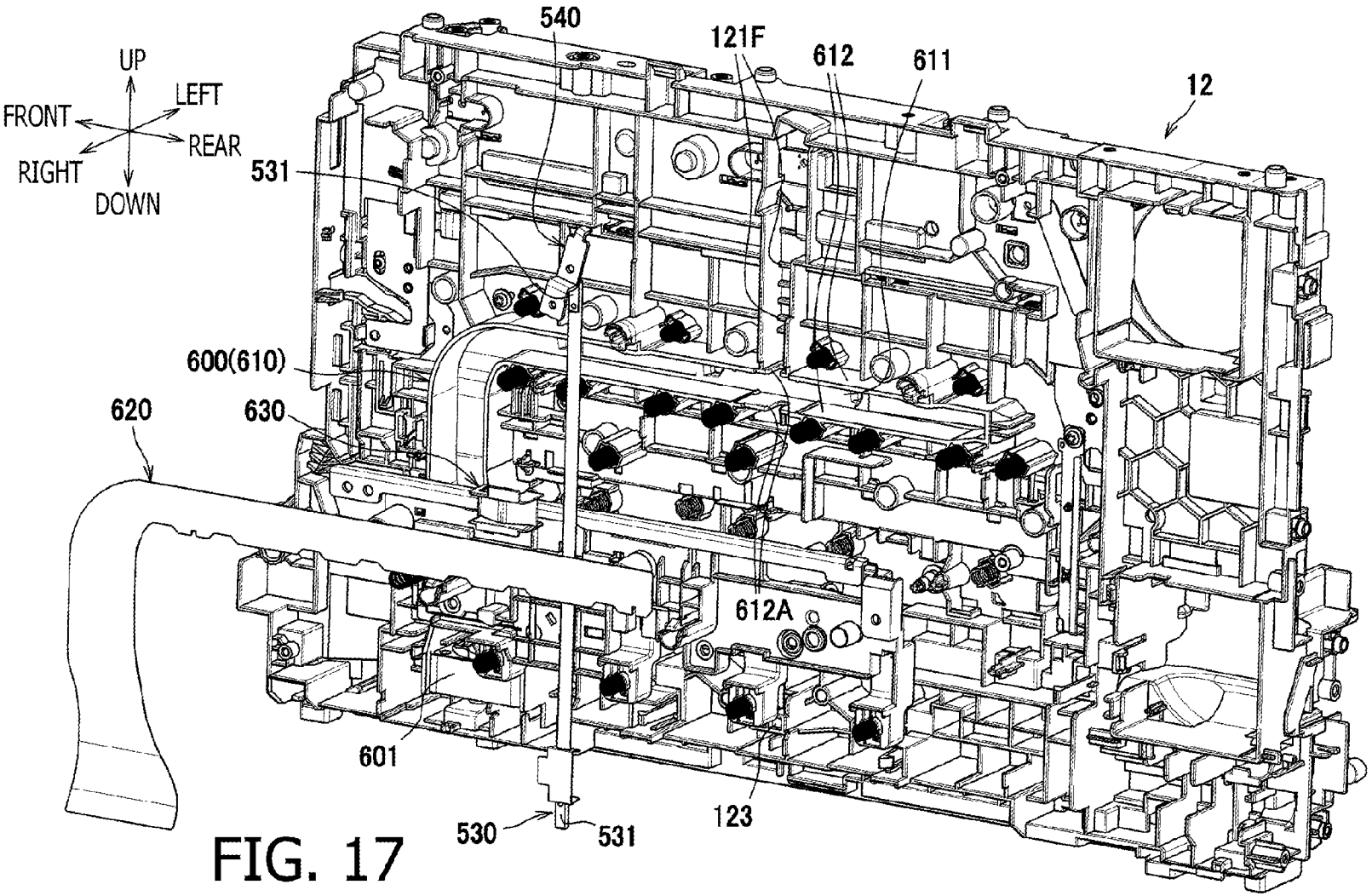
FIG. 17 is an exploded perspective view of the right-side frame, the first and second beams, and accompanying parts in the color printer according to the second embodiment of the present invention.

In a second embodiment, a form of the first metal beam 510 may not necessarily be limited to the bent-formed bar but may be, for example, in a shape of a cylindrical round rod, such as a first beam 530 shown in FIGS. 16 and 17. With the cylindrical first beam 530, which is in a compact form, rigidity of the first beam 530 may be maintained or improved.

More specifically, according to the second embodiment, the first beam 530 is a metal-made round rod with longitudinal (upper and lower) ends thereof being partly cutoff so that each longitudinal end portion of the first beam 530 is formed to have a first planar surface 531 along the longitudinal direction. The first beam 530 is engaged with the first engageable part 123, which is as described in the previous embodiment, at the lower end thereof. Meanwhile, the upper end of the metal beam 530 is retained in a clearance between a metal-made resilient plate member 540 and the right-side frame 12.

A diameter of the first beam 530 may be, for example, 5 mm. Meanwhile, a dimension of a thickest part of the first beam 530 at the longitudinal ends, in which the first planar surfaces 531 are formed, i.e., a dimension along a direction orthogonal to the first planar surface 531, may be 3.8 mm.

Figure 18:
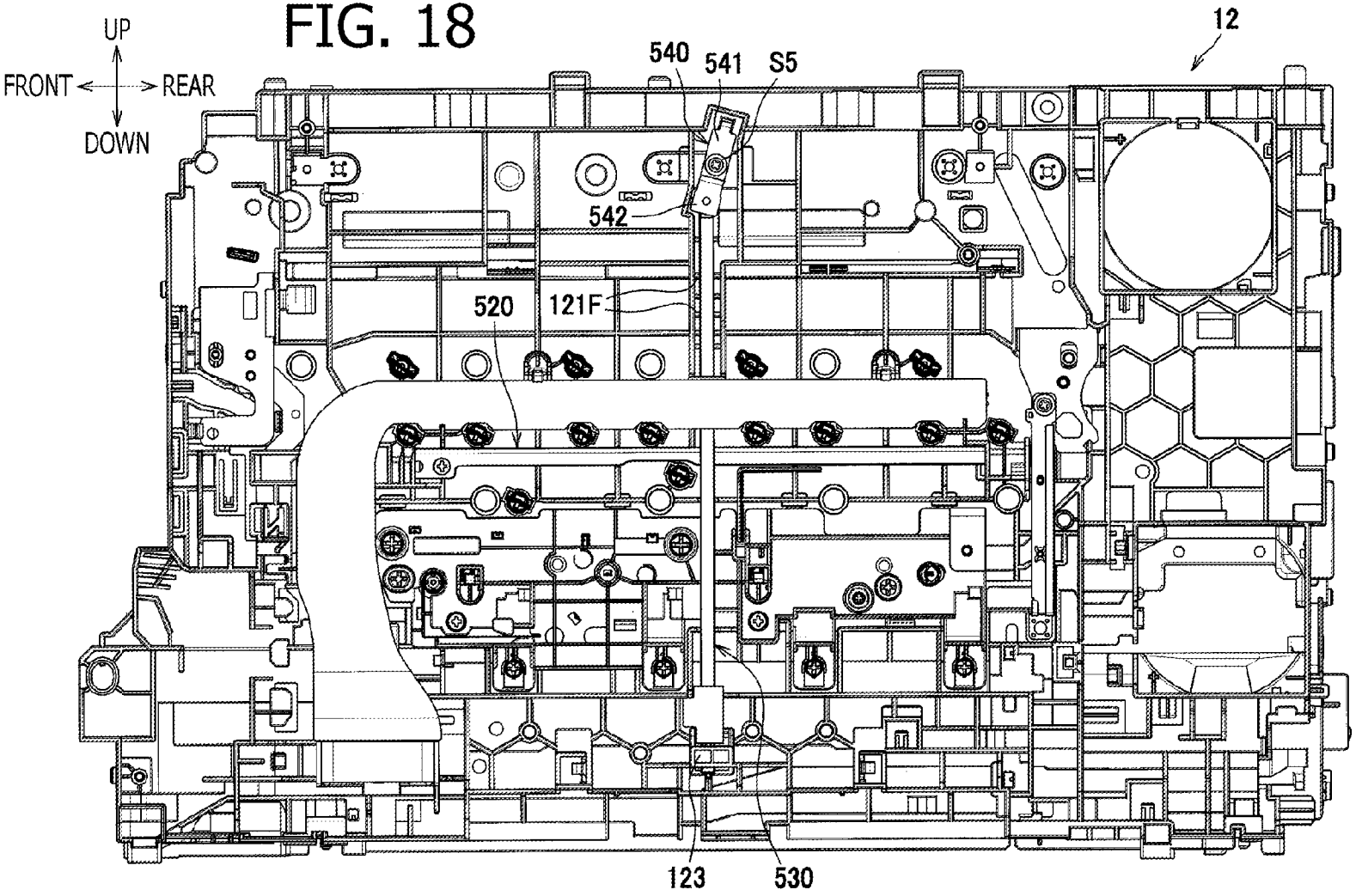
FIG. 18 is a lateral view of the right-side frame in the color printer according to the second embodiment of the present invention viewed from the outer side along the widthwise direction.
Figure 20A:
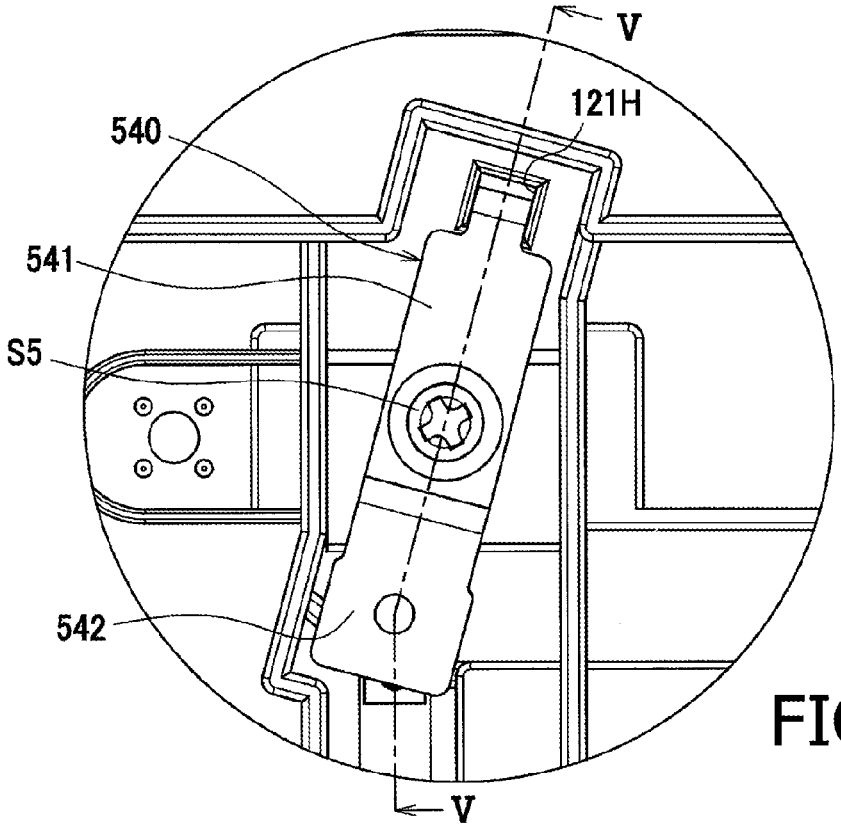
FIG. 20A is an enlarged partial view of a plate piece in the color printer according to the second embodiment of the present invention.
Figure 20B:
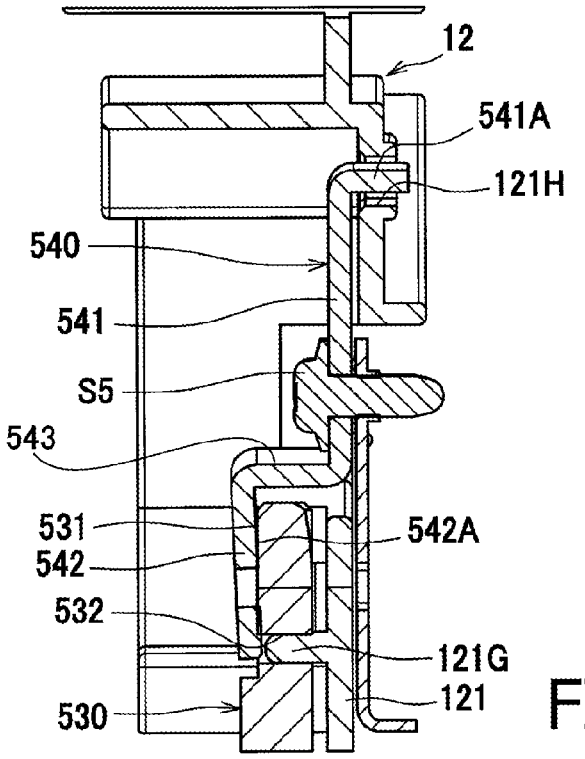
FIG. 20B is a cross-sectional view of the plate piece taken along a line V-V shown in FIG. 20A.

The plate member 540 is formed to have a first section 541, a second section 542, and a third section 543. The first section 541 spreads orthogonally to the widthwise direction, and while the third section 543 extends from a lower end of the first section 541 outwardly along the widthwise direction, the second section 542 extends from a widthwise outer end of the second section 543. As shown in FIGS. 18 and 20A-20B, the plate member 540 is fixed to the right-side frame 12 at the first section 541 while the second section 542 floats to form a free end.

In this regard, the second section 542 being the free end urges the upper end of the first beam 530 toward the right-side frame 12. More specifically, the second section 542 urges the upper end of the first beam 530 toward support ribs 121F, which will be described later in detail, of the right-side frame 12. Thus, the upper end of the first beam 530 is held in the clearance between the second section 542 and the right-side frame 12. Accordingly, the upper end of the first beam 530 is resiliently supported by the plate member 540 so that, when the load from the drawer 60 is applied to the right-side frame 12, damage at a part, wherein the upper end of the first beam 530 is attached to the right-side frame 12, can be restrained by resilient deformation of the plate member 540.

As shown in FIG. 20B, further, a side of the second section 542 facing the first beam 530 forms a second planar surface 542A, which is arranged to be in surface contact with the first planar surface 531. Thus, while the second section 542 of the plate member 540 and the upper end of the first beam 530 contact each other at the first and second planar surfaces 531, 542A, the upper end of the first beam 530 may be stably supported by the second section 542 of the plate member 540.

Further, in the first planar surface 531 of the first beam 530, a through-hole 532 which penetrates the first planar surface 532 toward the right-side frame 12, is formed. In the through-hole 532, a projection 121G, which projects from the surface of the flat part 121 in the right-side frame 12 toward the first beam 530, is inserted. Thereby, the first beam 530 is restricted from moving vertically with respect to the right-side frame 12.

Moreover, the plate member 540 is formed to have an engagement section 541A in an upper end portion of the first section 541. The engagement section 541A is inserted in an engagement hole 121H, which is formed in one of the flat parts 121 in the right-side frame 12, so that the engagement section 541A is engaged with the engagement hole 121H along the direction of shorter sides of the plate member 540.

Figure 19A:
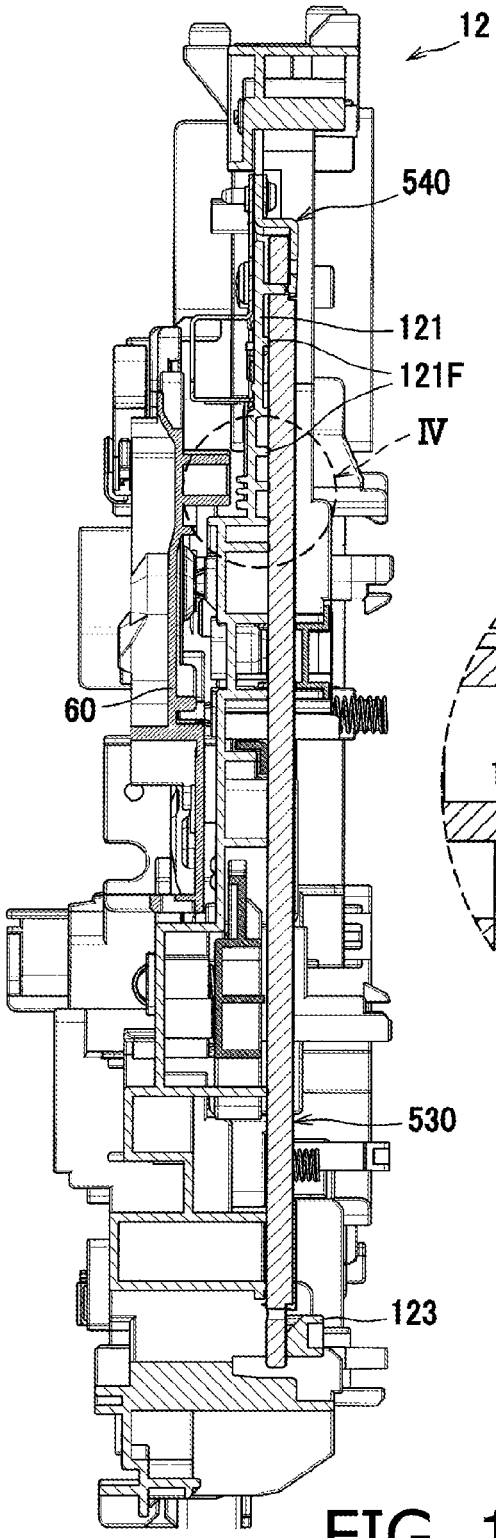
FIG. 19A is a front view of the right-side frame in the color printer according to the second embodiment of the present invention viewed along the front-rear direction.
Figure 19B:
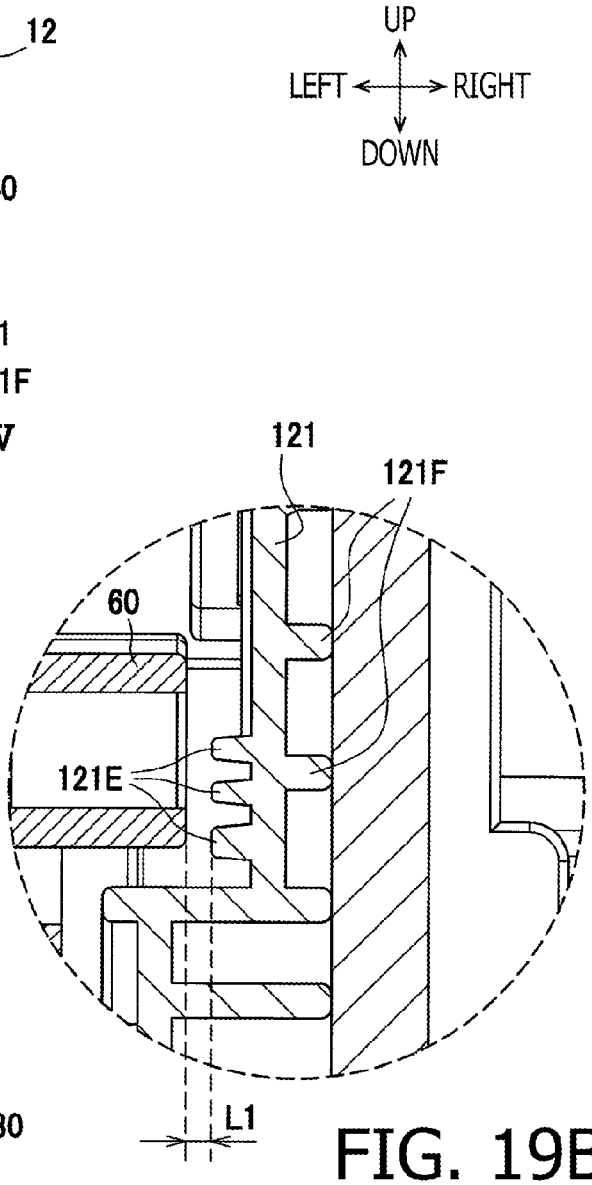
FIG. 19B is an enlarged partial view of an area indicated by a sign IV in FIG. 19A according to the second embodiment of the present invention.

As shown in FIGS. 17, 19A, and 19B, in upper positions in the right-side frame 12 in a central area along the front-rear direction, a plurality of support ribs 121F to contact an upper part (e.g., at approximately ⅓ of the length from the upper end) of the first beam 530 are formed. The support ribs 121F are formed to protrude from the flat part 121 of the right-side frame 12 toward the first beam 530 and are arranged to align along the longitudinal direction of the first beam 530.

With the plurality of support ribs 121F, when the load from the drawer 60 is applied to the right-side frame 12, the right-side frame 12 and the first beam 530 contact each other at the plurality of points; therefore, the load may be dispersed in the first beam 530 and restrained from concentrating on a single or smaller area in the first beam 530.

Further, as shown in FIG. 19B, one of the support ribs 12F is arranged to partly overlap upper two (2) of three (3) third projections 121E along the widthwise direction across the flat part 121. Therefore, the load transmitted to the upper two of the third projections 121E can be accepted by the metal-made first beam 530 through the support rib 121F.

As shown in FIGS. 16 and 17, the duct 600 includes a first duct part 610, a second duct part 620, and a shield member 630. The first duct part 610 is formed integrally with the right-side frame 12 and is formed to have a cross-sectional shape of a sideward-turned U being open outwardly along the widthwise direction. The second duct part 620 is arranged to cover the opening of the sideward-turned U of the first duct part 610. The shield member 630 is arranged inside the duct 600. Each of the first duct part 610 and the second duct part 620 has a portion elongated along the front-rear direction and a portion elongated long the vertical direction and, therefore, has an approximate shape of an L when viewed along the widthwise direction.

Figure 21:
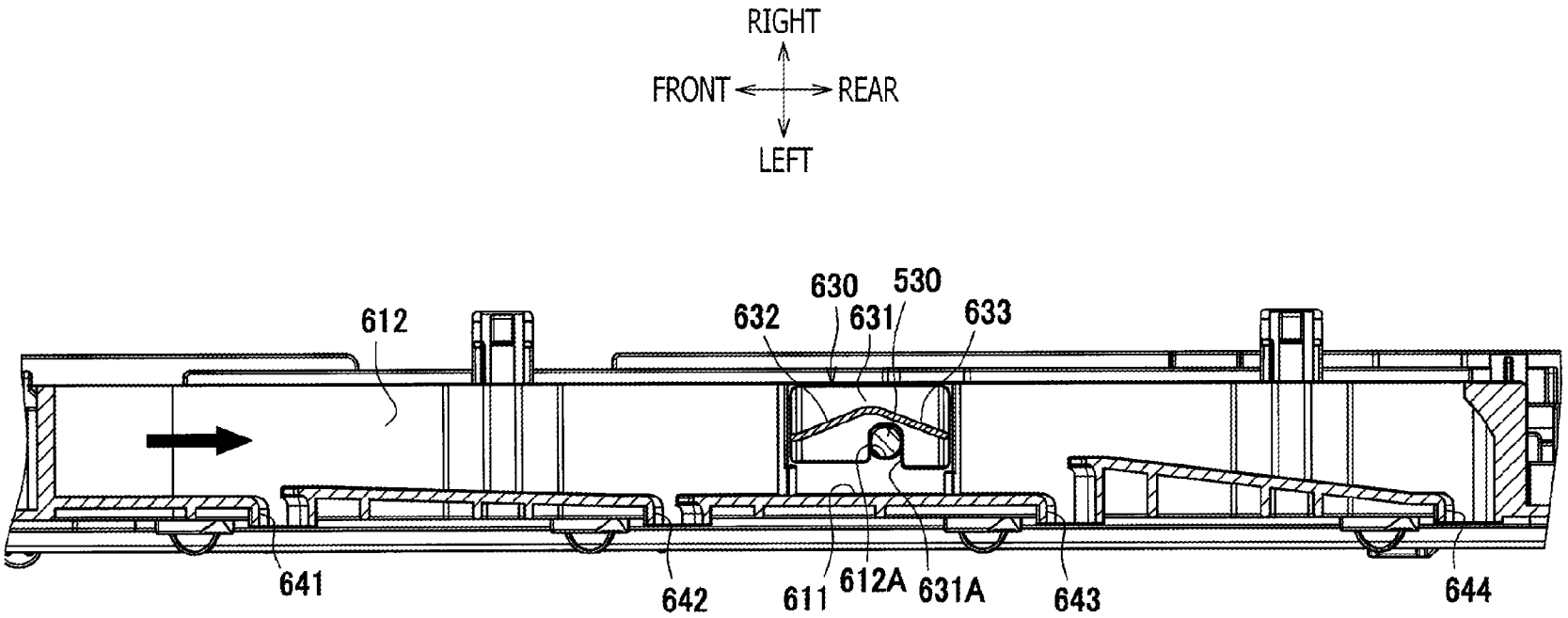
FIG. 21 is a cross sectional view of a duct in the image forming apparatus according to the second embodiment of the present invention.

The first duct part 610 includes a bottom part 611 in a position corresponding to a bottom of the sideward-turned U-shape, i.e., along the vertical direction, and a pair of side parts 612 spreading from an upper end and a lower end of the bottom part 611 outwardly along the widthwise direction. As shown in FIG. 21, in positions in the bottom part 611 of the first duct part 610 corresponding the processing units 50 along the widthwise direction, a first outlet 641, a second outlet 642, a third outlet 643, and a fourth outlet 644, through which the air to be blown toward the chargers 52 in the processing units 50 is discharged, are formed to align along the front-rear direction.

As shown in FIGS. 17 and 21, each of the paired side parts 612 is formed to have a groove 612A, through which the first beam 530 is arranged penetrate the first duct part 610. A dimension of the groove 612A along the front-rear direction is substantially equal to a diameter of the first beam 530, and a depth of the groove 612A, i.e., a dimension of the groove 612A along the widthwise direction, is greater than the diameter of the first beam 530. Further, a bottom of the groove 612A, i.e., a closed end along the widthwise direction of the groove 612A, does not reach the bottom part 611 of the first duct part 610 but is at a position outwardly apart from the bottom part 611 along the widthwise direction.

The shield member 630 is a resin piece, and a part of which is arranged in a position to block a part of an air path in the duct 600. Therefore, a cross-section of the air path in the duct is smaller at the part where the shield member 630 is arranged than the other part where the shield member 630 is not arranged. More specifically, the shield member 630 is arranged in a position between the second outlet 642 and the third outlet 643 along the front-rear direction. The shield member 630 includes a pair of covering walls 631 and an upstream-side angled wall 632 and a downstream-side angled wall 633, which are formed integrally.

The covering walls 631 are walls to cover the first beam 530 from the air path and arranged to contact inner surfaces of the side parts 612. Each covering wall 631 is formed to have a U-shaped groove 631A at a position corresponding to the groove 612A in the side part 612.

The upstream-side angled wall 632 is arranged in a position between the paired covering walls 631 to incline with respect to a blowing direction, which is indicated by an arrow in FIG. 21. More specifically, the upstream-side angled wall 632 is formed to incline to be separated farther away from the bottom part 611 as the upstream-side angled wall 632 spreads toward the downstream of the blowing direction. Therefore, sudden reduction of the cross-section of the air path at the area in the vicinity of the shield member 630 may be prevented, and a smooth flow of the air in the duct 600 may be maintained.

The downstream-side angled wall 633 is arranged in a position between the paired covering walls 631 on a downstream side of the upstream-side angled wall 632 with respect to the blowing direction and inclines with respect to the blowing direction. More specifically, the downstream-side angled wall 633 is formed to incline to approach closer to the bottom part 611 as the downstream-side angled wall 633 spreads toward the downstream of the blowing direction. Therefore, sudden increase of the cross-section of the air path at the area in the vicinity of the shield member 630 may be prevented, and a smooth flow of the air in the duct 600 may be maintained.

The upstream-side angled wall 632 and the downstream-side angled wall 633 are arranged to be spaced apart from the second duct part 620 (see FIG. 17) and from the bottom part 611. With this arrangement, the air is allowed to flow by both sides of the upstream-side angled wall 632 and the downstream-side angled wall 633, i.e., a right-hand side and a left-hand side along the widthwise direction.

The first beam 530 is arranged to penetrate the shield member 630 at a position between the upstream-side angled wall 632 and the downstream-side angled wall 633 to be shielded. Thereby, the air current may be restrained from being disturbed by the first beam 530 but may be allowed to flow smoothly in the duct 600.

Further, while the first beam 530 is formed in the compact shape of the round rod, the first beam 530 may be easily accommodated in the position between the upstream-side angled wall 632 and the downstream-side angled wall 633, and disturbance of the air current by the first beam 530 may be restrained.

In the embodiments described above, the first metal beam 510 and the first beam 530 are arranged along a direction orthogonal to the aligning direction of the plurality of processing units 50; however, the first metal beam and the first beam may be arranged along a direction, which is not necessarily orthogonal to the aligning direction, as long as the beam should intersect with the aligning direction.

For another example, the processing units 50 in the image forming unit 30 may be replaced with drum cartridges, in each of which a developer cartridge containing a developer roller is removably installed and is equipped with a photosensitive drum.

For another example, the metal-made plate member 540 providing resiliency may be replaced with a resin-made resilient member or a metal-made or resin-made rod member.

For another example, the spring electrodes 710, 730 may not necessarily include the compressed coiled springs but may include, for example, blade springs or torsion springs.

For another example, the embodiment described above may not necessarily be applied to a color printer but may be employed in, for example, a monochrome printer, a copier, or a multifunction peripheral device.

What is claimed is:

1. An image forming apparatus, comprising:

a plurality of image forming units, each of which comprises a photosensitive drum configured to be rotatable about a rotation axis, the plurality of image forming units being arranged to align along an aligning direction orthogonal to a direction of rotation axes of the photosensitive drums;

a first frame made of resin and arranged on one side of the plurality of image forming units along the direction of rotation axes, the first frame being configured to support the plurality of image forming units;

a first beam made of metal and formed in an elongated shape longitudinally along a direction to intersect with the aligning direction of the plurality of image forming units, the first beam being arranged along a planar face of the first frame and fixed to the planar face of the first frame; and a second beam formed in an elongated shape extending along the aligning direction, the second beam being arranged along the planar face of the first frame to intersect with the first beam and fixed to the planar face of the first frame, wherein rigidity of the first beam is higher than rigidity of the second beam.

2. The image forming apparatus according to claim 1, wherein the first beam and the second beam are arranged on an outer side of the first frame; and wherein the first beam is arranged on a side opposite from the plurality of image forming units across the second beam to contact the second beam.

3. The image forming apparatus according to claim 1, wherein the first beam is formed in a shape of a round rod.

4. The image forming apparatus according to claim 1, wherein the first frame comprises a plurality of ribs, the plurality of ribs being arranged to contact the first beam and to align along a longitudinal direction of the first beam.

5. The image forming apparatus according to claim 1, further comprising:

a resilient member fixed to the first frame at one part, another part of the resilient member forming a free end;

wherein the first beam is supported at one end thereof in a position between the another part of the resilient member and the first frame.

6. The image forming apparatus according to claim 5, wherein the one end of the first beam is formed to have a first planar surface along a longitudinal direction of the first beam; and wherein the another part of the resilient member is formed to have a second planar surface, the second planar surface being arranged to be in surface contact with the first planar surface.

7. The image forming apparatus according to claim 1, wherein the first beam is arranged to overlap the plurality of image forming unit at a longitudinal central part thereof, when projected along the direction of rotation axes, and longitudinal ends of the first beam are arranged on outer sides of the plurality of image forming units.

8. The image forming apparatus according to claim 1, wherein the second beam is formed of a metal bar having a first section, which spreads orthogonally to the direction of rotation axes, and a second section, which spreads from the first section along the direction of rotation axes.

9. The image forming apparatus according to claim 1, further comprising:

a second frame arranged to face the first frame across the plurality of image forming units; and a connecting frame configured to be connected to the first frame and the second frame, wherein one of longitudinal ends of the first beam is arranged to overlap the connecting frame when projected along the direction of rotation axes.

10. The image forming apparatus according to claim 1, wherein the first frame comprises a plurality of substrate supports, which are configured to support a substrate, the substrate being configured to supply electricity to the plurality of image forming units via spring electrodes, and wherein the spring electrodes are arranged in positions between the substrate and the plurality of image forming units in a compressed condition.

11. The image forming apparatus according to claim 10, wherein the plurality of substrate supports are arranged on an opposite side from the plurality of image forming units across the first frame; and wherein the first frame comprises through-holes, in which the spring electrodes are arranged to penetrate therethrough.

12. The image forming apparatus according to claim 1, wherein the first beam is arranged longitudinally along a direction orthogonally to the aligning direction of the plurality of image forming units.

13. The image forming apparatus according to claim 1, further comprising:

a drawer configured to support the plurality of image forming units, the drawer being supported by the first frame movably to move along the aligning direction, wherein the second beam is arranged to overlap the drawer when projected along the direction of rotation axes.

* * * * *